US009431184B2

(12) United States Patent
Lee et al.

(10) Patent No.: US 9,431,184 B2
(45) Date of Patent: Aug. 30, 2016

(54) CIRCUIT BREAKER

(71) Applicant: LSIS CO., LTD., Anyang-si, Gyeonggi-do (KR)

(72) Inventors: Hyun Wook Lee, Cheongju-si (KR); Young Woo Jeong, Cheongju-si (KR); Jin Hyun Park, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 15 days.

(21) Appl. No.: 14/521,066

(22) Filed: Oct. 22, 2014

(65) Prior Publication Data

US 2015/0123751 A1 May 7, 2015

(30) Foreign Application Priority Data

Nov. 6, 2013 (KR) ..... 10-2013-0134330
Nov. 6, 2013 (KR) ..... 10-2013-0134332

(51) Int. Cl.

*H01H 33/66* (2006.01)
*H01H 3/32* (2006.01)
*H01H 3/22* (2006.01)
*H01H 3/28* (2006.01)

(Continued)

(52) U.S. Cl.

CPC ..... *H01H 3/32* (2013.01); *H01H 3/222* (2013.01); *H01H 3/28* (2013.01); *H01H 33/40* (2013.01); *H01H 33/6662* (2013.01)

(58) Field of Classification Search

CPC ..... H01H 33/666
USPC ..... 335/22; 218/120, 141
See application file for complete search history.

(56) References Cited

U.S. PATENT DOCUMENTS 3,471,814 A * 10/1969 Burdett ..... H01F 7/1638 218/141
4,272,661 A * 6/1981 Dethlefsen ..... H01H 33/66 218/142
5,557,083 A * 9/1996 Komuro ..... B22F 3/26 218/123

(Continued)

FOREIGN PATENT DOCUMENTS

CN 1725407 1/2006
CN 102136400 7/2011

(Continued)

OTHER PUBLICATIONS

European Patent Office Application Serial No. 14189925.2, Search Report dated Mar. 19, 2015, 7 pages.

(Continued)

*Primary Examiner* — Alexander Talpalatski
(74) *Attorney, Agent, or Firm* — Lee Hong Degerman Kang & Waimey; Jonathan Kang; Jeffrey Lotspeich

(57) ABSTRACT

A vacuum interrupter includes a fixed contact and a movable contact; a driving unit including a main shaft and a plurality of links interlocked with the main shaft, to supply a driving force to open and close the vacuum interrupter; a power transmission unit to transmit a driving force of the driving unit to the movable contact; an over-current relay to detect a fault current and to output a trip signal to break a large-scaled current conduction; a trip unit to generate and transmit a mechanical operation force to the driving unit when a trip signal is output from the over-current relay; and a Thomson drive including a Thomson coil and a repulsive plate, to rotate the main shaft to an opening position or to transmit the trip signal to the trip unit, to promptly breaking a fault current.

19 Claims, 21 Drawing Sheets

(51) Int. Cl.
*H01H 33/40* (2006.01)
*H01H 33/666* (2006.01)

(56) References Cited

U.S. PATENT DOCUMENTS

| | | | | |
|---|---|---|---|---|
| 5,852,266 | A * | 12/1998 | Komuro | B22F 3/26 200/279 |
| 7,790,998 | B2 * | 9/2010 | Tsuchiya | H01H 33/6661 218/120 |
| 7,843,293 | B1 * | 11/2010 | Bonjean | H01H 3/28 218/154 |
| 8,247,725 | B2 * | 8/2012 | Morita | H01H 33/66207 218/120 |
| 2006/0028073 | A1 | 2/2006 | Sugino et al. | |
| 2008/0156775 | A1 * | 7/2008 | Morita | H01H 33/6662 218/140 |

FOREIGN PATENT DOCUMENTS

| | | |
|---|---|---|
| EP | 1544879 | 6/2005 |
| EP | 1939909 | 7/2008 |
| EP | 2028672 | 2/2009 |
| JP | 2000-299041 | 10/2000 |
| JP | 2008-117537 | 5/2008 |
| KR | 10-1280288 | 7/2013 |

OTHER PUBLICATIONS

Korean Intellectual Property Office Application Serial No. 10-2013-0134330, Notice of Allowance dated Apr. 29, 2015, 2 pages.
Korean Intellectual Property Office Application Serial No. 10-2013-0134332, Notice of Allowance dated Apr. 27, 2015, 2 pages.
State Intellectual Property Office of the People's Republic of China Application Serial No. 201410645238.X, Office Action dated Mar. 31, 2016, 5 pages.

* cited by examiner

CIRCUIT BREAKER

CROSS-REFERENCE TO RELATED APPLICATION

Pursuant to 35 U.S.C. §119(a), this application claims the benefit of earlier filing date and right of priority to Korean Application Nos. 10-2013-0134330, filed on Nov. 6, 2013 and 10-2013-0134332, filed on Nov. 6, 2013, the contents of which are all hereby incorporated by reference herein in its entirety.

BACKGROUND OF THE INVENTION

1. Field of the Invention

The present invention relates to a circuit breaker, and more particularly, to a circuit breaker, which is capable of enhancing the breaking speed of a fault current.

2. Description of the Conventional Art

As is well known in the art, a circuit breaker is an electrical device which is installed between a power supply and a load in order to protect load side equipments and electric lines in the event of an abnormal situation such as a fault current (short-circuit, large scale current by a ground fault) which may occur in an electric circuit.

FIG. 1 illustrates a circuit breaker in accordance with the conventional art. As shown in FIG. 1, the circuit breaker in accordance with the conventional art comprises a vacuum interrupter 10 including a fixed contact 14 and a movable contact 16, a driving mechanism or a driving unit 20 (hereinafter, referred to as a driving unit 20) configured to drive the movable contact 16 of the vacuum interrupter 10 to be brought into contact and separated from the fixed contact 14, and a power transmission unit 30 disposed between the driving unit 20 and the vacuum interrupter 10 and configured to transmit a driving force of the driving unit 20 to the movable contact 16.

The vacuum interrupter 10 includes a vacuum container 12 for maintaining a vacuum condition therein, the fixed contact 14 disposed within one side of the vacuum container 12, and the movable contact 16 configured to move between a closing position where it contacts the fixed contact 14 and an opening position (trip position) where it is spaced from the fixed contact 14 within the vacuum container 12.

One of the fixed contact 14 and the movable contact 16 is connected to a main line 17 and the other is connected to a load 18.

The driving unit 20, though not shown in the drawings specifically, but as is well known in the art, includes a main shaft 22 disposed to be rotatable between the closing position and the opening position, a plurality of springs (for instance, a closing spring and an opening spring, not shown) configured to generate a driving force to cause the main shaft 22 to promptly rotate between the closing position and the opening position, and a plurality of links 24 coupled together to transmit the driving force to the main shaft 24.

An over-current relay (not shown) is provided next to the driving unit 20 which detects a fault current and outputs a trip signal to break a conduction of a large scaled current.

A trip mechanism module or a trip unit 40 (hereinafter, referred to as a trip unit) is provided at one side of the driving unit 20. The trip unit 40 is configured to generate a mechanical operation force and transmit the mechanical operation force to the driving unit 20 when a trip signal is output from the over-current relay.

The trip unit 40 includes a trip lever 41 disposed at one side of one of the plurality of links 24 so as to be rotatable between a restricting position where the one of the plurality of links 24 is restricted from being moved toward the trip position, and a releasing position where the one of the plurality of links 24 are allowed to turn to the trip position; and a solenoid 50 configured to rotate the trip lever 41 to the releasing position.

The solenoid 50 includes a main body 51 and an operation rod 62 configured to protrude and retract from/into the main body 51.

The main body 51, though not shown specifically in the drawings, includes a coil that generates a magnetic force when a power is applied thereto, a yoke that forms a magnetic path, a fixed core that forms a magnetic path together with the yoke, a movable core disposed to be brought into contact with and separable from the fixed core, and a restoration spring to return the movable core to its initial position.

The operation rod 62 is configured to have one end connected to the movable core and another end protruded to outside of the main body 51.

The power transmission unit 30 includes a driving arm 32 coupled to the main shaft 22 and protruded in a radius direction, a first link 34 connected to the movable contact 16 and configured to move the movable contact 16 between the closing position and the opening position, and a second link 36 having one end connected to the driving arm 32 and another end connected to the first link 34.

Under such a configuration, a power is applied to a coil of the solenoid 50 by an opening signal and a trip signal. Once the power is applied to the coil of the solenoid 50, a magnetic force is generated and the magnetic force flows through the yoke and the fixed core. At this moment, the movable core moves in a direction that a magnetic resistance becomes smaller. The operational rod 62 is moved to protrude from the main body 51 when a power is applied to the coil of the solenoid 50. When the operational rod 62 is moved to protrude from the main body, the trip lever 41 is rotated to a releasing position.

Once the trip lever 41 is rotated to the releasing position, the main shaft 22 of the driving unit 20 is rotated to an opening position (trip position), and the driving force of the main shaft 22 is transmitted to the movable contact 16 by the power transmission unit 30, thereby breaking a current flow between the fixed contact 14 and the movable contact 16.

In such a conventional circuit breaker, however, when a trip signal is output according to detection of a fault current by the over-current relay, a power is applied to the coil of the solenoid to generate a magnetic force, and then the operation rod 62 is moved to release the trip lever 41, thereby requiring a relatively long time to perform such an operation in sequence. Thus, it is difficult to reduce time taken to break a fault current by separating the movable contact 16 from the fixed contact 14 after the over-current relay outputs a trip signal.

SUMMARY OF THE INVENTION

Therefore, an object of the present invention is to provide a circuit breaker, which is capable of promptly breaking a fault current.

Another object of the present invention is to provide a circuit breaker, which is capable of restraining a time delay when transferring a trip signal.

It is a further object of the present invention to provide a circuit breaker, which is capable of breaking a fault current within 1.5 cycles after a trip signal is transmitted.

It is a still further object of the present invention to provide a circuit breaker, which is capable of restraining generation of an operation delay of a driving unit.

To achieve these and other advantages and in accordance with the purpose of this specification, as embodied and broadly described herein, there is provided a circuit breaker, including a vacuum interrupter including a fixed contact and a movable contact; a driving unit including a main shaft rotatable between a closing position where the movable contact contacts the fixed contact and an opening position where the movable contact is separated from the fixed contact, and a plurality of links interlocked with the main shaft, and configured to supply a driving force to open and close the vacuum interrupter; a power transmission unit disposed between the driving unit and the vacuum interrupter and configured to transmit a driving force of the driving unit to the movable contact; an over-current relay configured to detect a fault current and to output a trip signal to break a large-scaled current conduction; a trip unit disposed at one side of the driving unit and configured to generate and transmit a mechanical operation force to the driving unit when a trip signal is output from the over-current relay; and a Thomson drive including a Thomson coil and a repulsive plate configured to be spaced from the Thomson coil by an electromagnetic repulsive force when a power is applied to the Thomson coil, and configured to be connected to the power transmission unit to rotate the main shaft to an opening position by a movement of the repulsive plate when a power is applied to the Thomson coil, or configured to be provided at the trip unit to transmit the trip signal to the trip unit by a movement of the repulsive plate when a power is applied to the Thomson coil.

The circuit breaker may further include a control unit configured to apply a power to the Thomson coil when a trip signal is output from the over-current relay; and an unlatch unit disposed at one side of one of the plurality of links and configured to be rotatable between a restricting position where the driving unit is restricted from being rotated to the opening position and a releasing position where the driving unit is rotated from the restricting position so that the driving unit is rotated to the opening position when the main shaft is rotated to the opening position by the Thomson drive The Thomson drive may be connected to the power transmission unit, the trip unit may be disposed at one side of an unlatch unit and configured to rotate the unlatch unit to a releasing position when the opening signal is applied; and.

The unlatch unit may include an operation pin configured to contact one of the links; a first trip latch including the operation pin and configured to be rotatable so that the operation pin may be rotated to the restricting position and the releasing position; a first trip latch spring configured to apply an elastic force to the operation pin so as to be in contact with the one of the links; a second trip latch disposed to be relative-rotatable with respect to the first trip latch and having one side contacting the operation pin; and a second trip latch spring having one end supported by the first trip latch and another end elastically supporting the second trip latch in a contacting manner.

The trip unit may include a trip lever disposed to contact the second trip latch and configured to restrict the first trip latch and the second trip latch from being rotated to a releasing position; and a solenoid disposed at one side of the trip lever and configured to rotate the trip lever to the releasing position where the first trip latch and the second trip latch are rotatable to the releasing position.

The power transmission unit may include a driving arm having one end connected to the main shaft and another end protruded in a radius direction; a first link connected to the movable contact and configured to be rotatable between a closing position where the movable contact contacts the fixed contact and an opening position where the movable contact is spaced from the fixed contact; and a second link having one end connected to the driving arm and another end connected to the first link.

The repulsive plate may include a connection rod extended from the Thomson coil in a penetrating manner and connected to the power transmission unit.

The connection rod may be connected to a connection region between the first link and the second link.

The connection rod may be connected to the first link.

The first link may be provided with a compression spring configured to apply an elastic force to the movable contact so as to be in contact with the fixed contact at a predetermined pressure, and the connection rod may be connected to a connection region between the first link and the push rod.

The connection rod may be connected to a connection region between the driving arm and the second link The Thomson drive may be provided at the trip unit. The trip unit may include a trip latch disposed to be rotatable between a restricting position where one of the links is restricted to be rotated to the closing position by contacting with the one of the plurality of links that rotate the main shaft to the closing position and a releasing position where the one of the links is allowed to rotate to the closing position; and a trip lever disposed at one side of the trip latch and configured to restrict or release the trip latch to rotate to the releasing position, and the Thomson drive may include a signal transmission actuator. The signal transmission actuator may include a Thomson coil disposed at one side of the trip lever; and a repulsive plate disposed at one side of the Thomson coil and configured to move the trip lever to the releasing position when a power is applied to the Thomson coil.

The power transmission unit may include a driving arm connected to the main shaft; a first link disposed at one side of the movable contact and configured to move the movable contact to the closing position and the opening position; and a second link having one end connected to the driving arm and another end connected to the first link.

The Thomson drive may further include a Thomson coil disposed at one side of the power transmission unit; and an acceleration actuator including a repulsive plate configured to move the power transmission unit to the opening position by being spaced from the Thomson coil by an electromagnetic repulsive force generated when a power is applied to the Thomson coil.

The repulsive plate of the acceleration actuator may include a connection rod passing through and extended from the Thomson coil in a penetrating manner.

The connection rod may be connected to one of the connection region between the first link and the second link, the connection region between the driving arm and the second link, and the first link.

The first link may be connected to the push rod having one end connected to the movable contact, and the connection rod may be connected to the connection region between the first link and the push rod.

The repulsive plate may include an operation rod which is protruded toward the trip lever.

The circuit breaker of the present invention may further include a housing configured to accommodate therein the Thomson coil and the repulsive plate.

The repulsive plate may include a guide rod which is protruded in a moving direction, and the housing may include a guide slot configured to guide movement of the guide rod.

The circuit breaker of the present invention may further include a control unit configured to control that a power to be applied to the Thomson coil when a trip signal is output from the over-current relay, and wherein the control unit may control a power to be applied to the acceleration actuator when a predetermined time passes after a power has been applied to the signal transmission actuator.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENT

Hereinafter, a preferred embodiment of a circuit breaker according to the present invention will now be described in detail with reference to the accompanying drawings.

Figure 1:
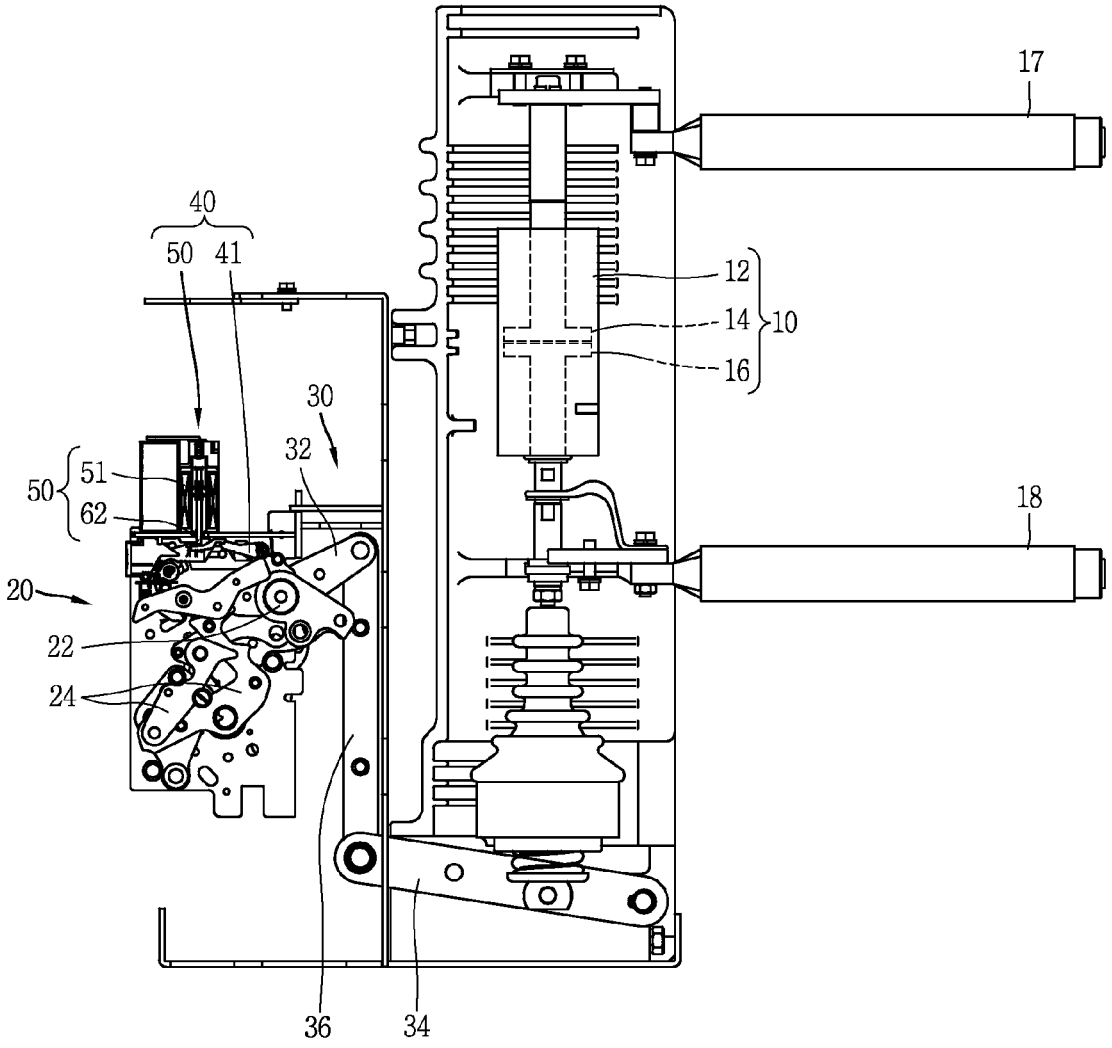
FIG. 1 RELATED ART
FIG. 1 illustrates a circuit breaker in accordance with the conventional art.
Figure 2:
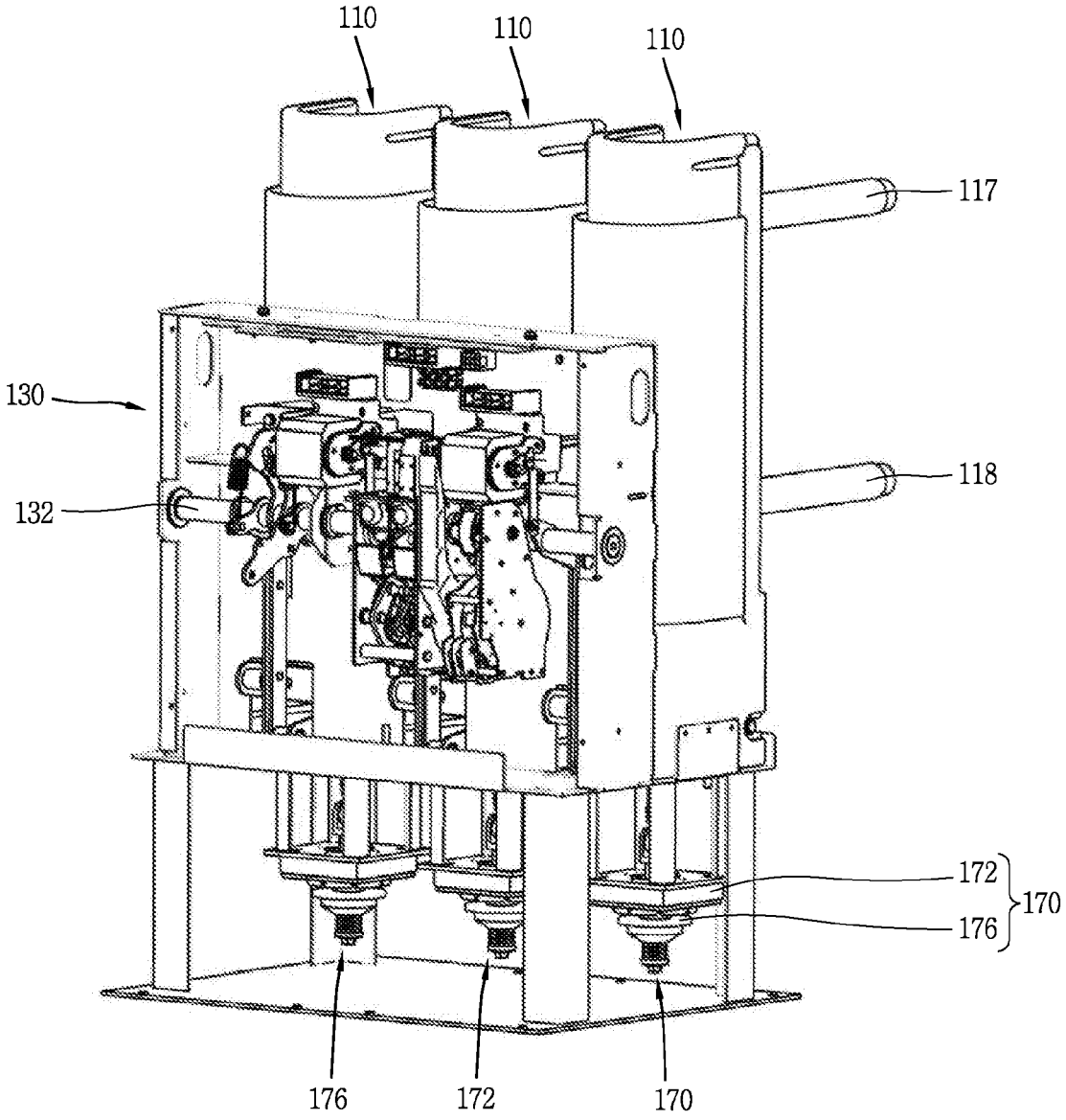
FIG. 2 is a perspective view illustrating a circuit breaker according to an embodiment of the present invention.
Figure 3:
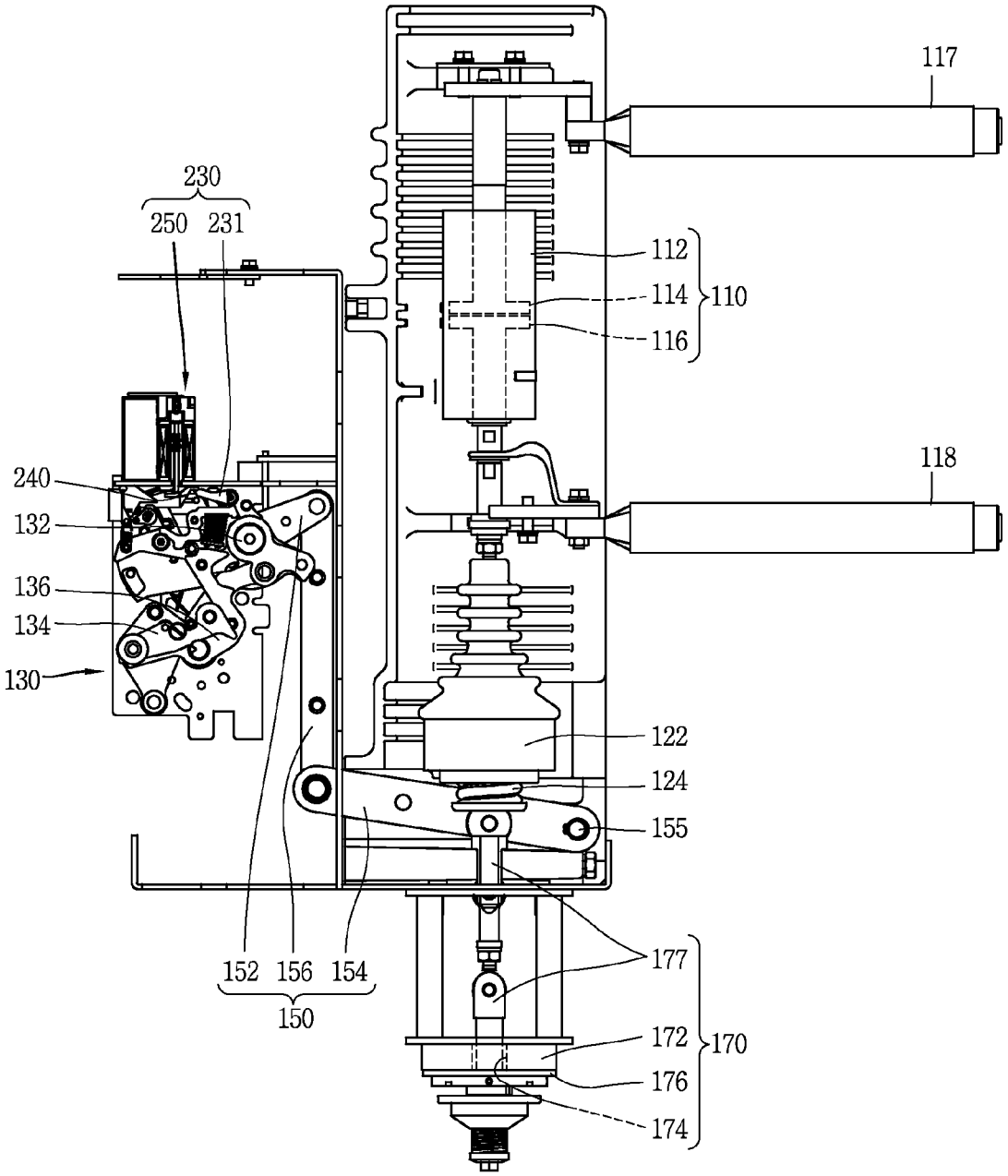
FIG. 3 is a side view illustrating the circuit breaker of FIG. 2.

As shown in FIGS. 2 and 3, a circuit breaker according to an embodiment of the present invention may include a vacuum interrupter 110 including a fixed contact 114 and a movable contact 116; a driving unit 130 including a main shaft rotatable between a closing position where the movable contact 116 contacts the fixed contact 114 and an opening position where the movable contact 116 is separated from the fixed contact 114 and a plurality of links 134 interlocked with the main shaft 132, and configured to supply a driving force to open and close the vacuum interrupter 110; a power transmission unit 150 disposed between the driving unit 130 and the vacuum interrupter 110 and configured to transmit a driving force of the driving unit 130 to the movable contact 116; a Thomson drive 170 connected to the power transmission unit 150 and configured to rotate the main shaft 132 to the opening position when a power is applied; and an unlatch unit 190 disposed at one side of one of the plurality of links 134 and configured to be rotatable between a restricting position where the driving unit 130 is restricted to rotate to the opening position and a releasing position where the driving unit 130 is rotated from the restricting position so that the driving unit 130 is rotated to the opening position when the main shaft 132 is rotated to the opening position by the Thomson drive 170.

The vacuum interrupters 110 may be disposed to be spaced from each other by phases (e.g., R, S and T phases).

In the embodiment of the present invention, it is exemplarily described that three vacuum interrupters 110 are spaced apart from each other in a horizontal direction.

Each of the vacuum interrupters 110 may include a vacuum container 112, a fixed contact 114 disposed within the vacuum container 112, and a movable contact 116 disposed within the vacuum container 112 to be in contact with and separable from the fixed contact 114. One of the fixed contact 114 and the movable contact 116 may be connected to a main power line 117 and the other may be connected to a load 118.

A push rod 122 may be extendedly connected to the movable contact 116 in a lengthwise direction.

The push rod 122 may be provided with a compression spring 124 that applies an elastic force to the movable contact 116 so as to contact the fixed contact 114 at a predetermined pressure.

The driving unit 130, configured to provide a driving force to move the movable contact 116 toward the fixed contact 114, may be disposed at one side of the vacuum interrupter 110.

Figure 4:
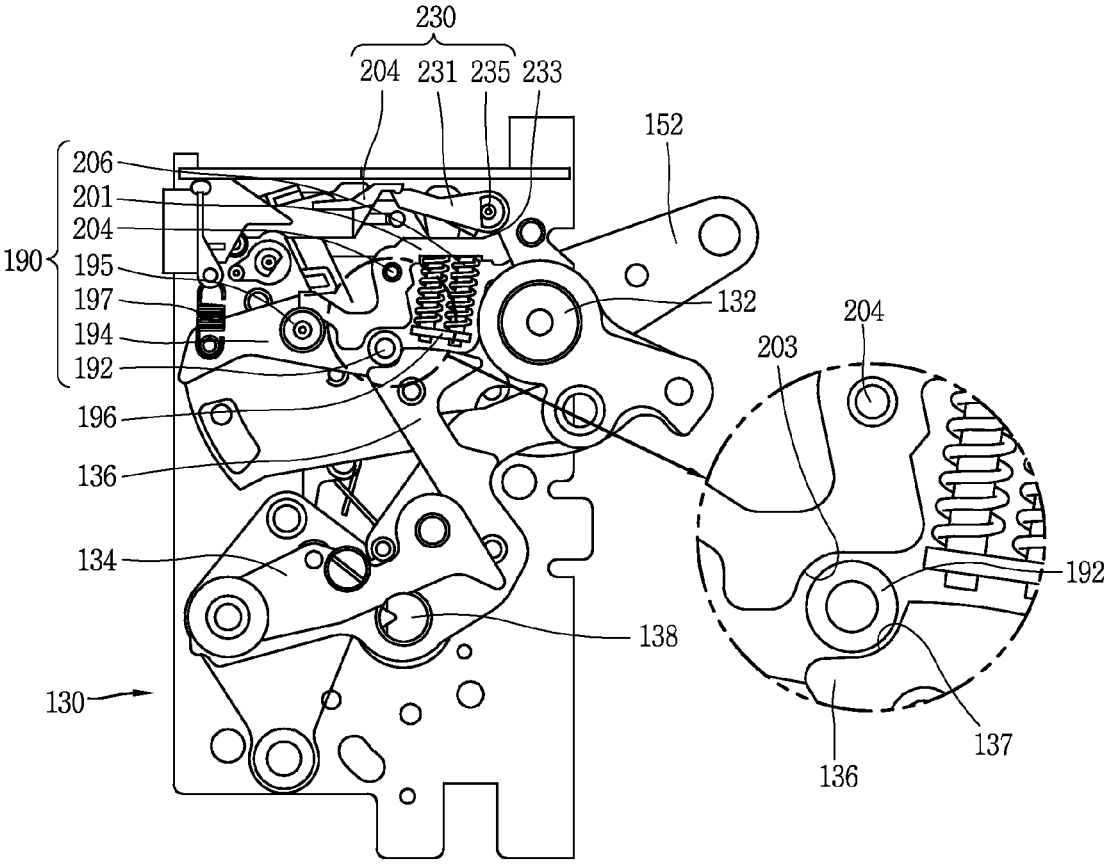
FIG. 4 is an enlarged view illustrating a driving unit of FIG. 3.

As shown in FIG. 4, the driving unit 130 may include a main shaft 132 configured to be rotatable between a closing position where the movable contact 114 contacts the fixed contact 116 and an opening position where the movable contact 116 is separated from the fixed contact 114, and a plurality of links 134 interlocked with the main shaft 132.

The driving unit 130, though not shown in the drawings in detail, may include a plurality of springs (for instance, a closing spring and an opening spring) providing an elastic force to rotate the main shaft 132 to the closing position and the opening position, respectively.

The power transmission unit 150 may be provided between the driving unit 130 and the vacuum interrupter 110 to transmit the driving force from the driving unit 130 to the movable contact 116.

The power transmission unit 150 may include a driving arm 152 having one end connected to the main shaft 132 and another end protruded in a radius direction; a first link 154 configured to be rotatable between a closing position where the movable contact 116 contacts the fixed contact 114 and an opening position where the movable contact 116 is separated from the fixed contact 114; and a second link 156 having one end connected to the driving arm 152 and another end connected to the first link 154.

The first link 154 may be connected to a lower end of the push rod 122 so as to be relatively movable.

The first link 154 may be configured to rotate up and down centering around a pivot shaft 155 provided at one end thereof.

The Thomson drive 170 may be provided to rotate the main shaft 132 to the opening position.

The Thomson drive 170 may include a Thomson coil 172 disposed at a lower side of the power transmission unit 150; and a repulsive plate 176 disposed below the Thomson coil 172 and configured to move to be spaced from the Thomson coil 172 by an electromagnetic repulsive force generated when a power is applied to the Thomson coil 172 to rotate the main shaft 132 to an opening position.

The Thomson coil 172 and the repulsive plate 176 may be configured to have a delay time of 0.5 milliseconds (ms) until the repulsive plate 175 starts to move upon applying a power to the Thomson coil 172. Under such a configuration, it is possible to remarkably reduce an operation time (about more than 9.5 ms) when compared with the conventional one in which 10 ms were required to get the operation rod to start to move upon applying a power to the solenoid.

The Thomson coil 172 may be configured to have a disk shape.

The Thomson coil 172 may have a through-hole 174 at the central portion thereof.

The repulsive plate 176 may be configured to have a disk shape.

The Thomson drive 170, as is well known in the art, may be configured in such that an eddy current to generate an electromagnetic repulsive force together with the Thomson coil 172 may be generated by the repulsive plate 176 when a power is applied to the Thomson coil 172. Under such a configuration, the repulsive plate 176 can be promptly separated from the Thomson coil 172 by the electromagnetic repulsive force generated between the Thomson coil 172 and the repulsive plate 176 when a power is applied to the Thomson coil 172.

The repulsive plate 176 may include a connection rod 177 that penetrates through the Thomson coil 172 to thus be connected to the power transmission unit 150.

As shown in FIG. 3, the connection rod 177 may be connected to the first link 154.

More specifically, the connection rod 177 may be relative-movably connected to a connection region between the first link 154 and the push rod 122.

Here, the connection rod 177 may be configured as one or a plurality of parts (rods) connected with each other.

The connection rod 177 may be connected to the first link 154 so as to be relative-movable.

Figure 13:
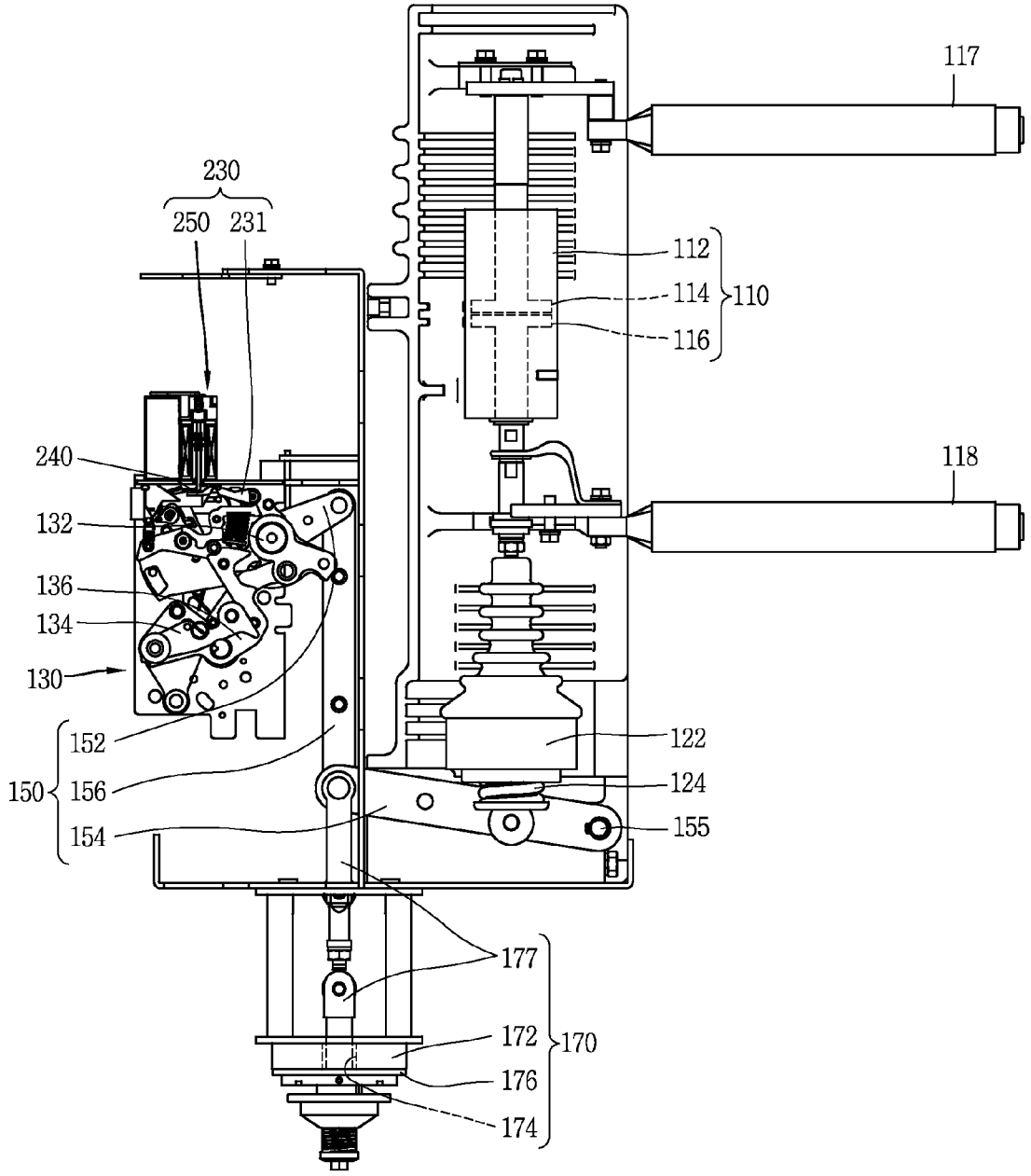
FIGS. 13 and 14 are views illustrating another embodiment of the circuit breaker of FIG. 2.

Here, as shown in FIG. 13, the connection rod 177 may be connected to a connection region between the first link 154 and the second link 156. In this case, the stroke of the repulsive plate 176 may be increased when compared with the embodiment of FIG. 3, whereas the output (driving force) can be reduced, thereby reducing electric power consumption.

Figure 14:
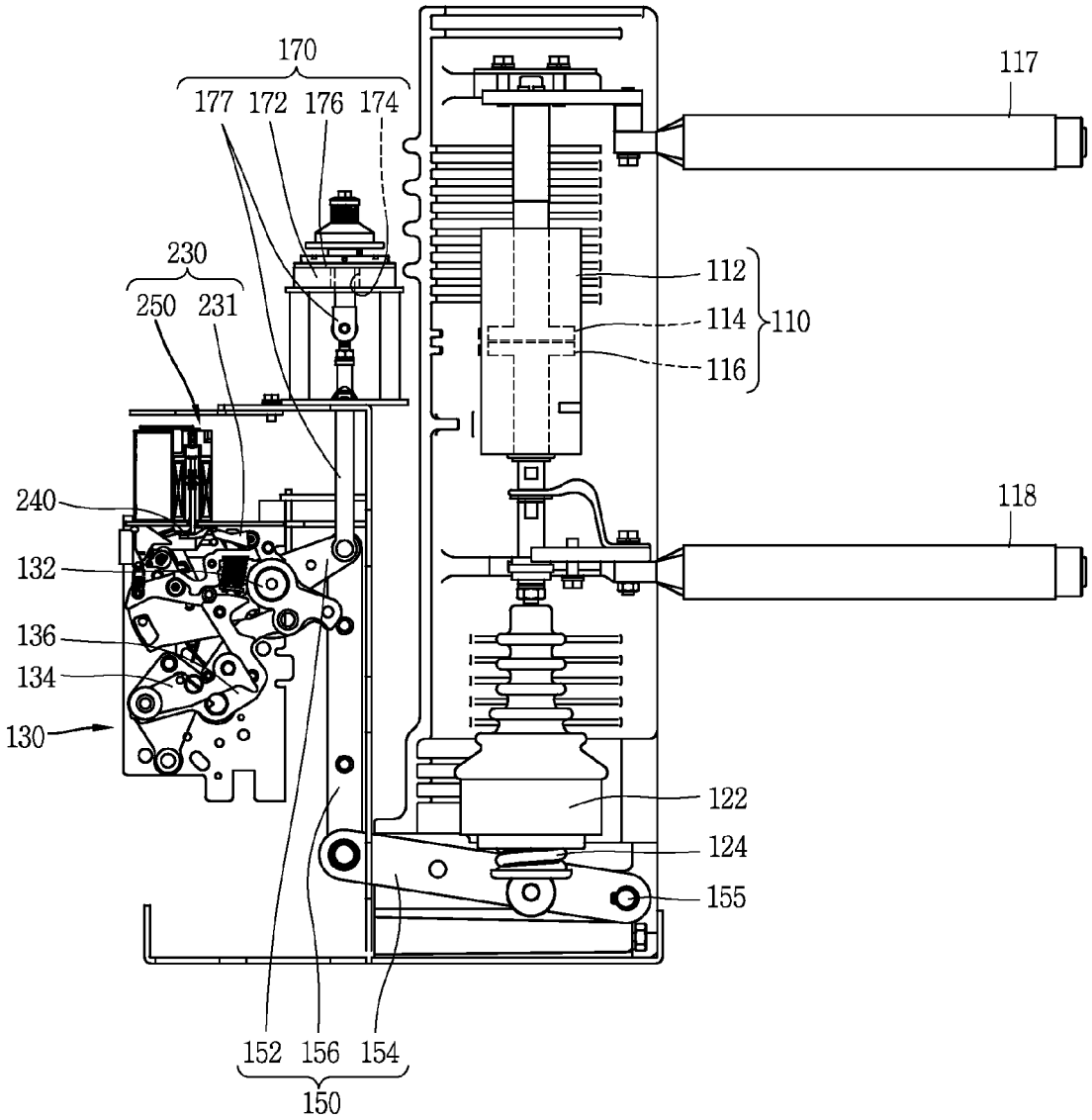

Further, as shown in FIG. 14, the connection rod 177 may be connected to a connection region between the driving arm 152 and the second link 156. In this case, the output and the stroke may be appropriately adjusted.

Meanwhile, the driving unit 130 may include an unlatch unit 190 that rotates the main shaft 132 to the opening position when a power is applied to the Thomson drive 170.

The unlatch unit 190 may include an operation pin 192 that contacts the one link 136; a first trip latch 194 including the operation pin 192 at one side and configured to be rotatable so that the operation pin 192 may be moved to a restricting position and a releasing position, respectively; a first trip latch spring 197 configured to apply an elastic force to the operation pin 192 to contact the one link 136; a second trip latch 201 disposed to be relative-movable with respect to the first trip latch 194 and having one end contacting the operation pin 192; and a second trip latch spring 206 having one end supported by the first trip latch 194 and another end elastically supporting the second trip latch 201 in a contacting manner.

Here, the one link 136 may be one of the links 134 that are provided at one side of the main shaft 132 and rotate the main shaft 132 to an opening position.

An operation pin accommodating recess 137 configured to accommodate therein a part of the operation pin 192 may be formed at an upper portion of the one link 136.

The trip latch 194 may be disposed so as to be rotatable at an upper portion of the one link 136.

The first trip latch spring 197, configured to apply an elastic force to the operation pin 192 to contact the one link 136, may be provided at one side of the first trip latch 194.

The first trip latch spring 197 may be implemented as a tension spring.

The operation pin 192 may be provided at one side of the pivot shaft 195 of the first trip latch 194.

The second trip latch 201 may be provided at one side of the first trip latch 194 so as to be relative-movable.

A pivot shaft 204 of the second trip latch 201 may be provided at the first trip latch 194 so as to be spaced from the pivot shaft 195 of the first trip latch 194 and an upper portion of the operation pin 195.

The second trip latch 201 may include a recess portion 203 recessed in correspondence to the shape of the operation pin 192.

Figure 11:
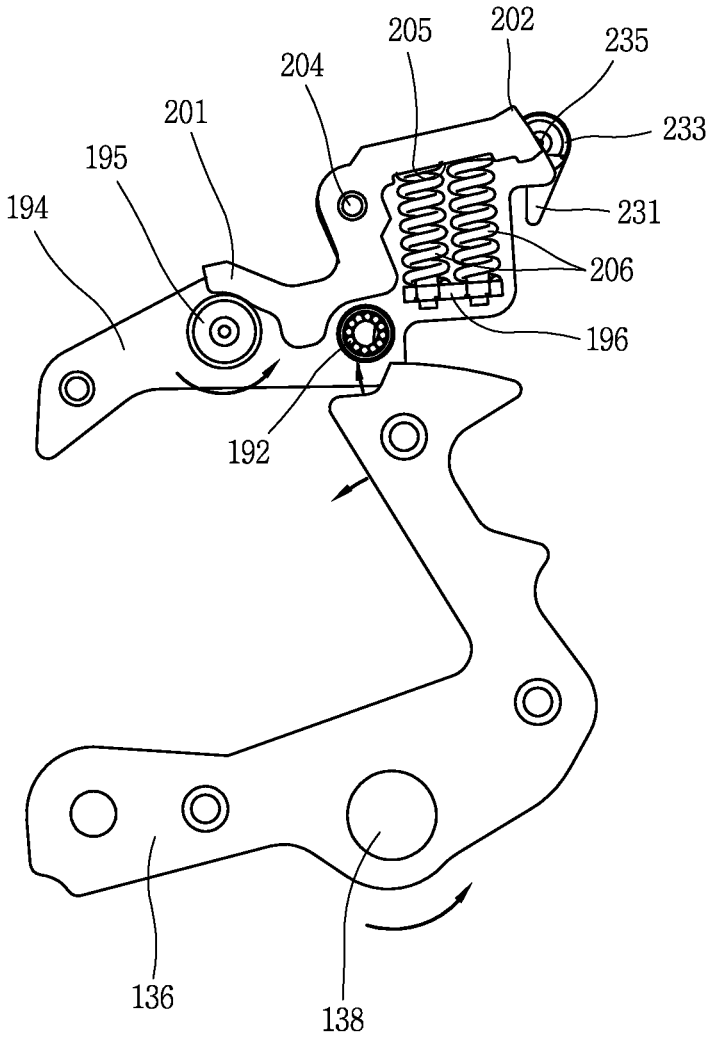
Figure 12:
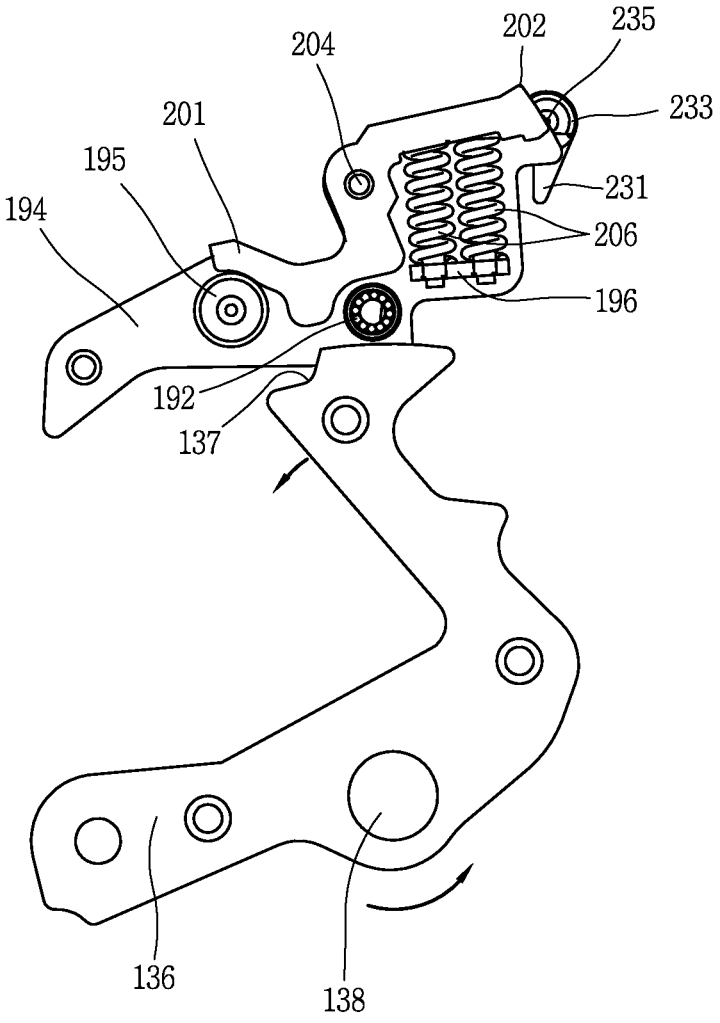

The second trip latch 201 may include a trip lever contact portion 202 which is formed to protrude and configured to contact a trip lever 231 (refer to FIGS. 11 and 12).

The second trip latch spring 206 may be provided between the first trip latch 194 and the second trip latch 201 to elastically support the second trip latch 201 toward the first trip latch 194.

The second trip latch spring 206 may be configured such that one end thereof (a lower end in the drawings) is supported by the first latch 194 and another end (an upper end in the drawings) is supported by the second trip latch 201.

The second trip latch spring 201 may be provided in plurality in number.

In this embodiment of the present invention, the second trip latch springs 201 are exemplarily shown in two, but may be one or three or more.

The first trip latch 194 may include a second trip latch spring support portion 196 to support a lower end of the second trip latch spring 206.

The second trip latch spring support portion 196 may be formed to protrude from the surface of the first trip latch 194 toward the second trip latch 201.

The second trip latch 201 may include a second trip latch spring accommodating portion 205 to accommodate therein and support an upper end of the second latch spring 206.

The second trip latch spring accommodating portion 205 may be formed to be in an upper-recessed manner.

The trip unit 230, configured to rotate the unlatch unit 190 to a releasing position when an opening signal is applied, may be provided at one side of the unlatch unit 190.

The trip unit 230 may include a trip lever 231 that contacts the second trip latch 201 and restrains the first trip latch 194 and the second trip latch 201 from being rotated to the releasing position; and a solenoid 250 disposed at one side of the trip lever 231 and configured to rotate the trip lever 231 to the releasing position where the first trip latch 194 and the second trip latch 201 are rotated to the releasing position.

The solenoid 250 may include a main body 251 and an operation rod 262 protruded and retractable from/into the main body 251.

Figure 15:
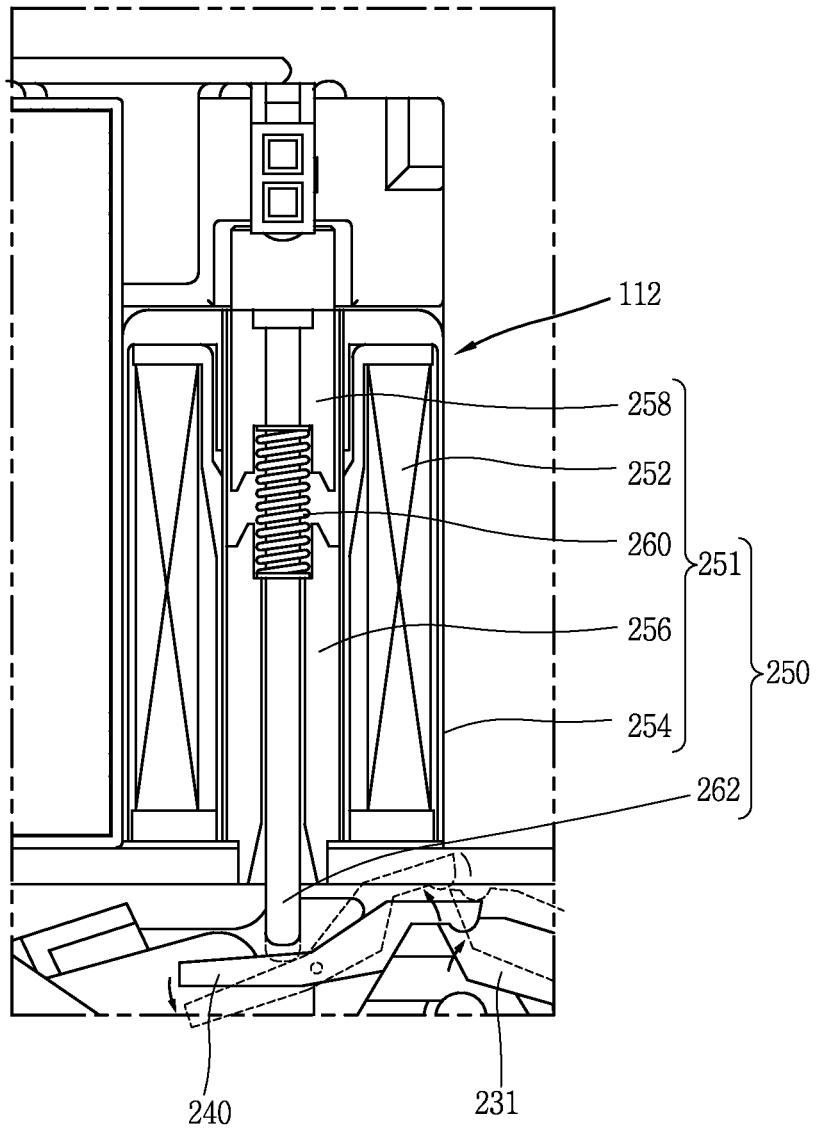
FIG. 15 is an enlarged view illustrating a solenoid of FIG. 3.
Figure 16:
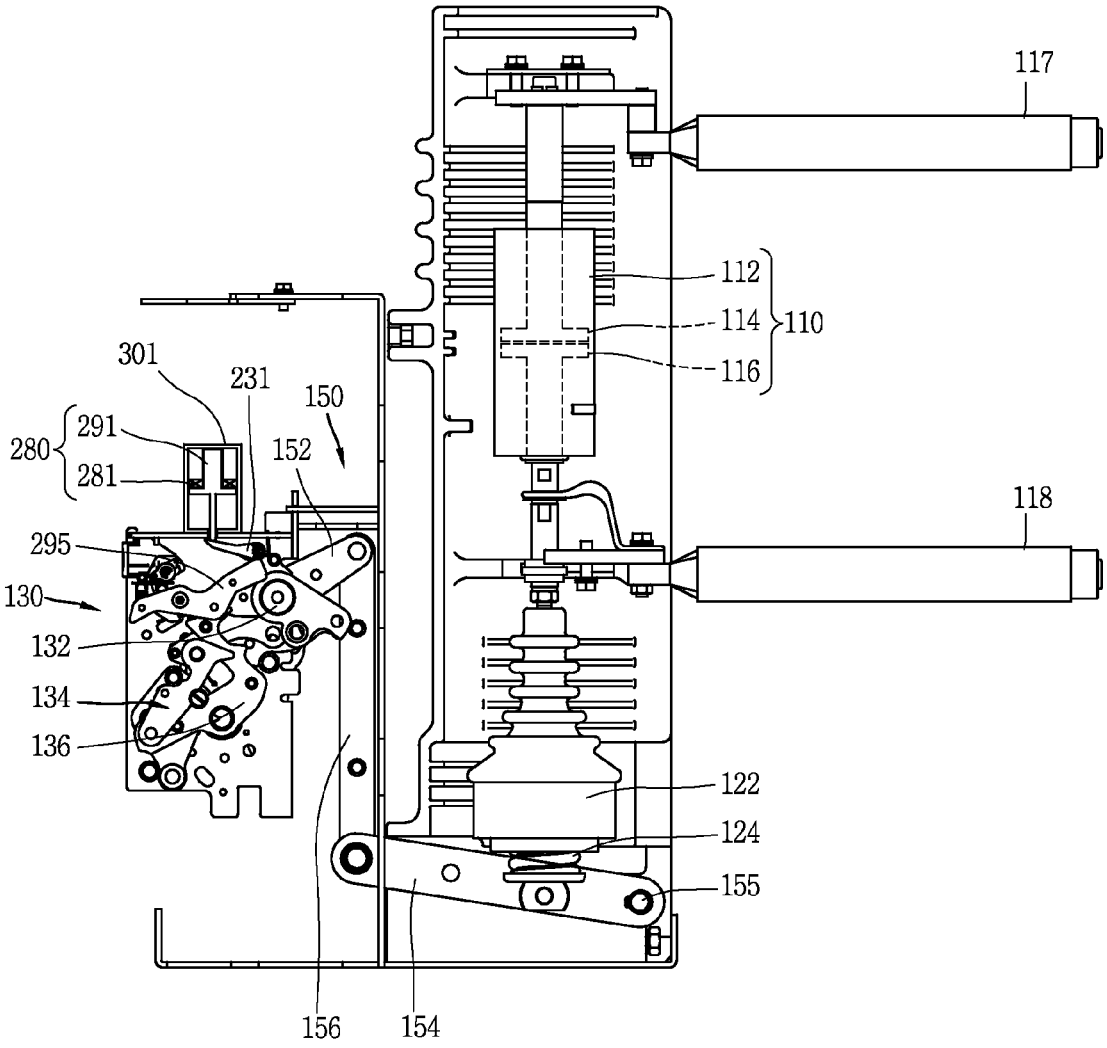
FIG. 16 is a side view illustrating a circuit breaker according to an embodiment of the present invention.
Figure 17:
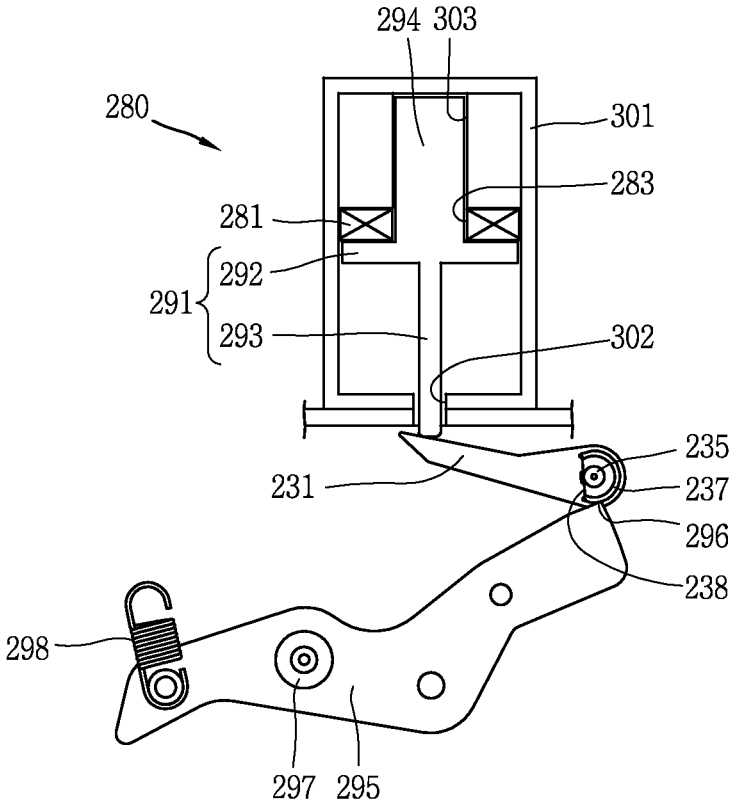
FIG. 17 is an enlarged view illustrating a signal transmission actuator of FIG. 16.

As shown in FIG. 15, the main body 251 may include a coil 252 generating a magnetic force upon applying a power thereto, a yoke 254 and a fixed core 256 forming a magnetic path, a movable core 258 disposed to be close to and separable from the fixed core 256, an operation rod 262 connected to the movable core 256 so as to be movable together with the movable core 256, and a restoration spring 260 to return the movable core 258 to an initial position.

The fixed core 256 and the movable core 258 may be disposed within the coil 252.

The fixed core 256 may include a through-hole through which the operation rod 262 passes.

The trip lever 231 may be configured to rotate centering around a pivot shaft 235 provided at one side of the second trip latch 201.

The trip lever 231 may be configured to be rotatable between the restricting position where the second trip latch 201 is restricted from being rotated to the releasing position and the releasing position where the second trip latch 201 is allowed to rotate to the releasing position.

A second trip latch contact portion 233 configured to contact the second trip latch 201 may be formed at one side of the trip lever 231. More specifically, the trip lever contact portion 202 contacts the second trip latch contact portion 231, so that rotation of the first trip latch 194 to the opening position can be restricted.

The trip lever 231 may be configured such that the second trip latch contact portion 233 contacts the second trip latch 201 to restrict rotation of the second trip latch 201 in the restricting position, and the second trip latch contact portion 233 is spaced from the second trip latch 201 to allow rotation of the second trip latch 201 and the first trip latch 194 to the releasing position.

A restraining lever 240, configured to restrain the trip lever 231 from being rotated to the releasing position, may be provided at one side of the trip lever 231.

The restraining lever 240 may be configured to be rotatable between a restricting position where one end of the restraining lever 240 contacts the trip lever 231 to restrain rotation of the trip lever 231 and a releasing position where one end of the restraining lever 240 is spaced from the trip lever 231 to allow rotation of the trip lever 231.

Another end of the restraining lever 240 may be configured to cooperate with the operation rod 262 of the solenoid 250.

The restraining lever 240 may be configured such that one end thereof which has contacted the trip lever 231 is separated from the trip lever 231 when the operation rod 262 of the solenoid 250 is protruded, so that the trip lever 231 may rotate to a releasing position.

Here, though not shown in detail in the drawings, the trip lever 231 may be configured to rotate to the releasing position by a trip lever spring.

Further, the restraining lever 240 may be configured as a plurality of levers which are coupled to be interlocked with each other.

Further, in this embodiment of the present invention, it is exemplarily described that the restraining lever 240 is disposed between the solenoid 250 and the trip lever 231, but the solenoid 250 may be configured to directly restrain or release the restraint of the trip lever 231.

Meanwhile, the circuit breaker in accordance with this embodiment of the present invention, may include a control unit 270 which contains a control program and is implemented as a microcomputer.

Figure 5:
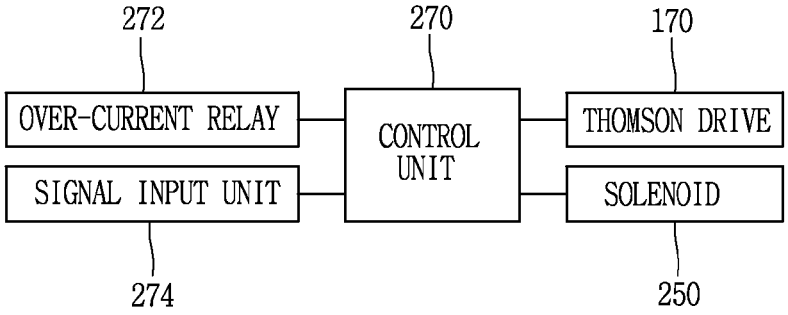
FIG. 5 is a block diagram illustrating a control procedure of the circuit breaker of FIG. 2.

As shown in FIG. 5, an over-current relay 272, configured to detect a fault current and output a trip signal to break a large-scaled current conduction, may be connected to the control unit 270 in a communicable manner.

The control unit 270 may be configured to apply a power to the Thomson coil 172 when a trip signal is output from the over-current relay 272.

A signal input unit 274, configured to input a closing signal and/or an opening signal, may be connected to the control unit 270.

The control unit 270 may be configured to control a power to be applied to the solenoid 250 when an opening signal is input.

Under such a configuration, when an opening signal is input by the signal input unit 274, the control unit 270 may control a power to be applied to the coil 252 of the solenoid 250.

When a power is applied to the coil 252 of the solenoid 250, the operation rod 262 is protruded and thereby the restraining lever 240 is rotated.

Figure 10:
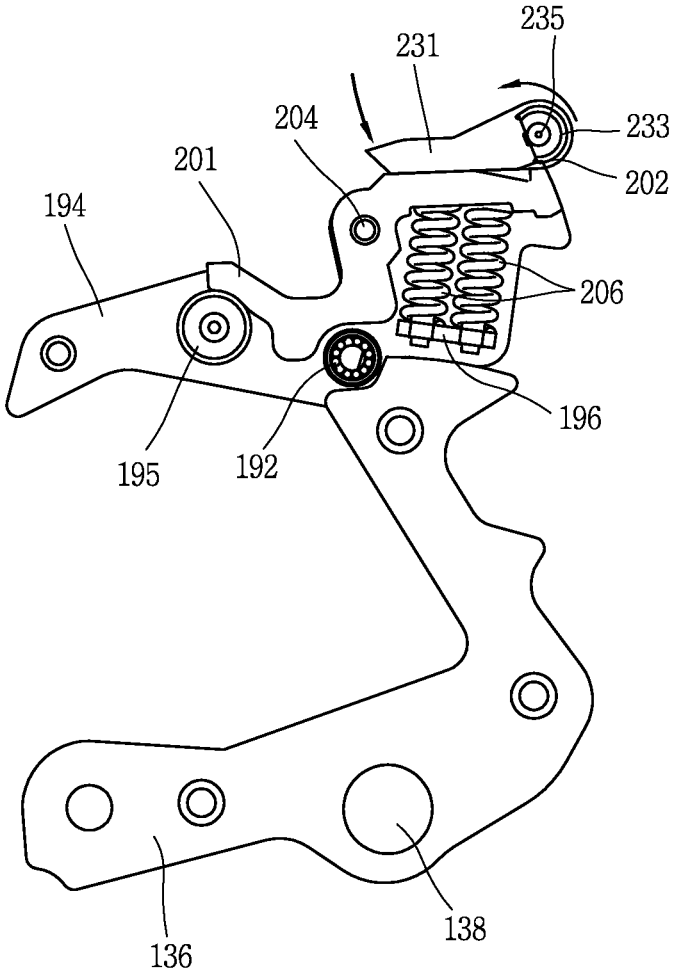

As the restraining lever 240 rotates, the restraint of the trip lever 231 is released as shown in FIG. 10, and the trip lever 231 rotates to a releasing position.

By the rotation of the trip lever 231, the first trip latch 194 is released from the restraint as shown in FIG. 11, and rotates counterclockwise centering around the pivot shaft 195. Thus, the operation pin 192 is spaced from the one link 136, and the one link 136 may be rotated counterclockwise as shown in FIG. 12, since the operation pin 192 is released from the restraint.

When the one link 136 is rotated counterclockwise, namely to the breaking position, the main shaft 132 can be rotated to a breaking position.

When the main shaft 132 is rotated to the breaking position, the driving arm 152 is rotated clockwise and the second link 156 and the first link 154 can be interlocked with each other.

The first link 154 moves the compression spring 124 and the push rod 122 to a breaking position, thereby the movable contact 116 is separated from the fixed contact 114 and is moved downward. By this consecutive movement of the elements, connection of the load 118 and the main power line 117 is released so that power supply to the load 118 can be stopped.

When a fault current is detected and a trip signal is output from the over-current relay 272, the control unit 270 controls the Thomson drive 172 to be driven.

When a power is applied to the Thomson coil 272 by the control unit 270, the repulsive plate 176 can be promptly moved in a direction to be spaced from the Thomson coil 172. Here, it takes 0.5 ms from detecting a fault current by the over-current relay 272 to initiation of a movement of the repulsive plate 176. Thus, the breaking time can be remarkably reduced (by 9.5 ms) when compared with the case where it takes 10 ms to initiate the trip operation of the trip lever 231 by the solenoid 250.

More specifically, when a power is applied to the Thomson coil 172 and the repulsive plate 176 is moved to a trip position, the first link 154 can be rotated downward in the drawings.

By the rotation of the first link 154, the second link 156 is moved downward, and thereby the driving arm 152 and the main shaft 132 can be rotated clockwise in the drawings.

Figure 6:
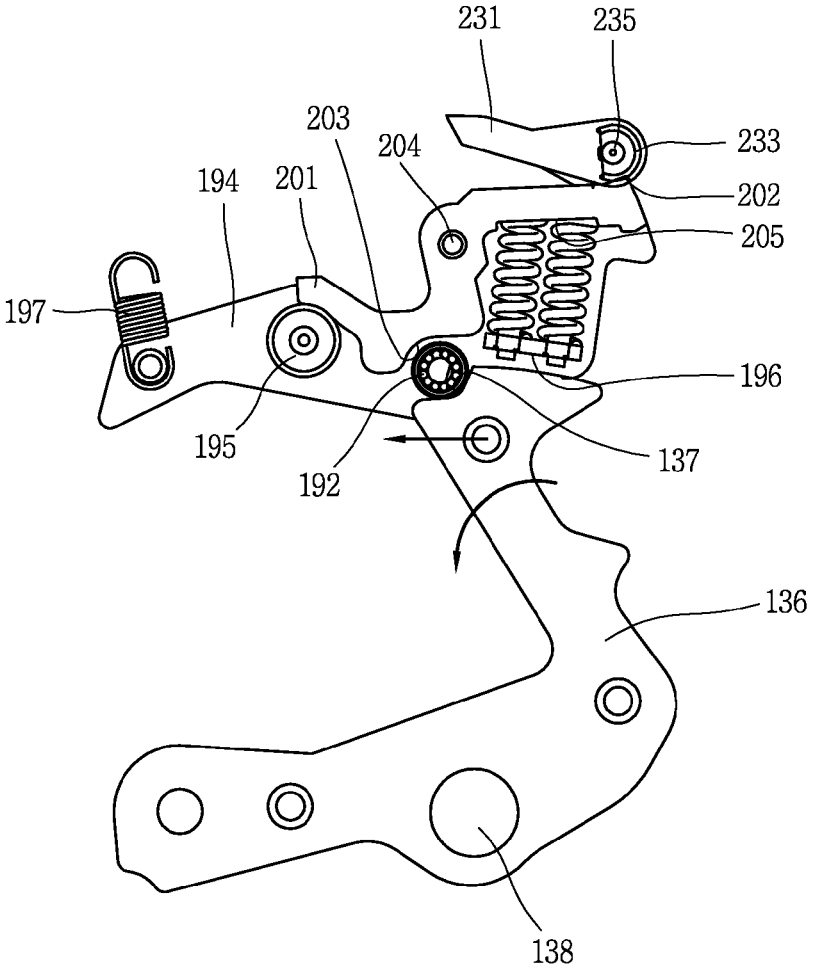
FIGS. 6 through 8 are views illustrating an operation of an unlatch unit.

When the main shaft 132 is rotated to the breaking position, the one link 136 can be rotated counterclockwise centering around the pivot shaft 138, as shown in FIG. 6.

Figure 7:
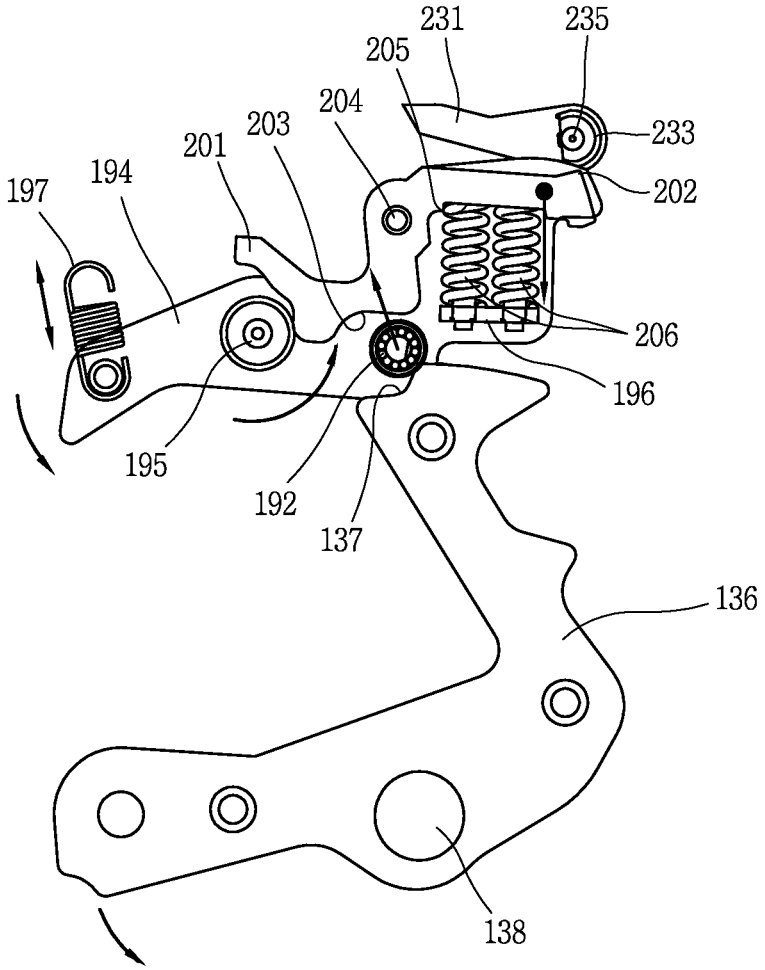
Figure 8:
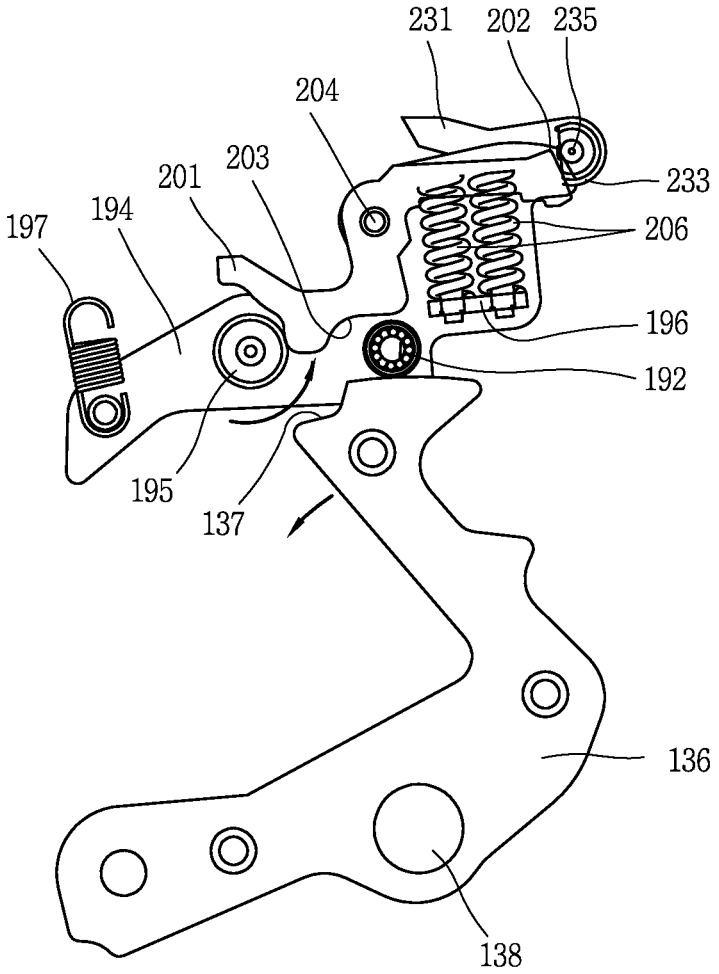
Figure 9:
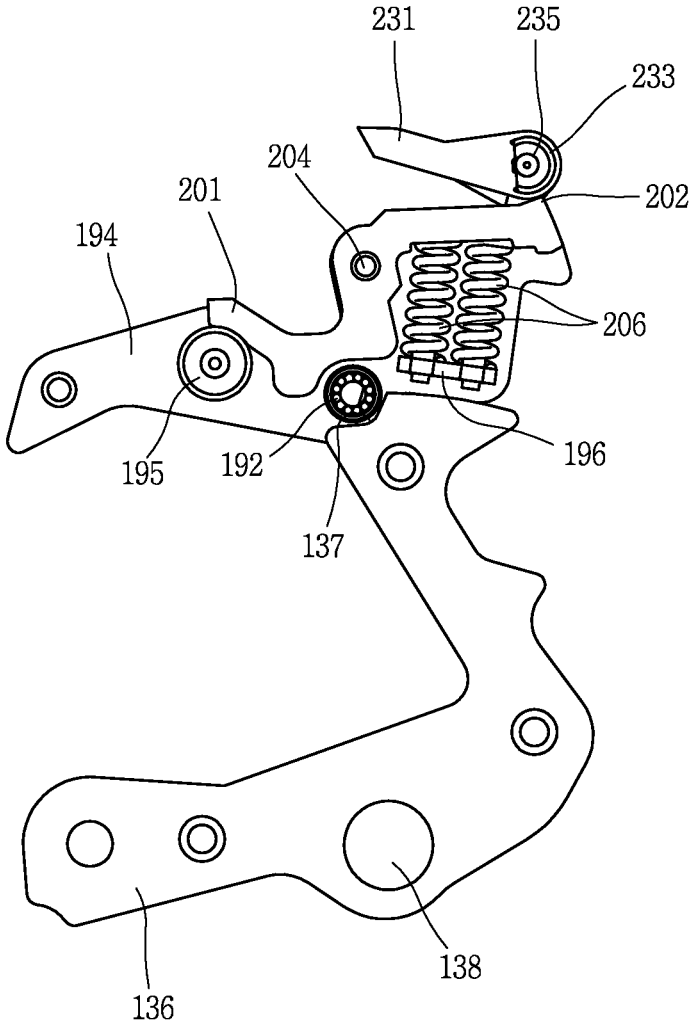
FIGS. 9 through 12 are views illustrating an operation of a trip unit and the unlatch unit when an opening signal is input.

As the one of the links 136 rotates counterclockwise, the operation pin 192 is compressed upward as shown in FIG. 7, thereby the first trap latch 194 can be rotated counterclockwise centering around the pivot shaft 195.

Here, the second trap latch spring 206 is compressed, and the first trap latch 194 and the second trap latch 201 are continuously rotated centering around the pivot shaft 204, so that the trap lever contact portion 202 of the second trap latch 201 is moved from the trap lever 231 (substantially, the second trap lever contact portion 233) so as to be released from the restraint state by the trip lever 231.

As the first trip latch 194 rotates counterclockwise centering around the pivot shaft 195, the operation pin 192 is separated from the one link 136, and the one link 136 is released from the restraint by the operation pin 192 to thus be rotatable to a breaking position.

Here, the Thomson drive 170 is provided to promptly release the unlatch unit 190, and a driving force to substantially drive the movable contact 116 is generated by the driving unit 130 (an elastic force of the breaking spring) and is transmitted to the movable contact 116 by the power transmission unit 150.

When the main shaft 132 is rotated to a breaking position, the driving arm 152 can be rotated clockwise in the drawing. By this operation, the second link 156 can be moved downward and the first link 154 can be rotated downward counterclockwise centering around the pivot shaft 155.

As the first link 154 rotates counterclockwise, the compression spring 124 is elongated and the push rod 122 is moved downward in the drawings. Thus, the movable contact 116 is separated from the fixed contact 114 and then moved downward. As a result, the fault current can be promptly cut-off.

As described above in detail, the circuit breaker according to this embodiment of the present invention can complete a fault current cut-off operation within 1.5 cycles (25 ms) upon input of a trip signal by separating the movable contact 116 from the fixed contact 114 to break a fault current when the fault current is detected by the over-current relay 272. More specifically, the circuit breaker according to this embodiment can complete a fault current cut-off operation within one cycle (16.7 ms) after outputting a trip signal irrespective of the position of the Thomson drive 170.

Hereinafter, another embodiment of the present invention will be described with reference to FIGS. 16 through 19.

As shown in FIGS. 16 through 19, the circuit breaker according to another embodiment of the present invention may include a vacuum interrupter 110 including a fixed contact 114 and a movable contact 116; a driving unit 130 including a main shaft 132 configured to be rotatable between a closing position where the movable contact 115 contacts the fixed contact 114 and an opening position where the movable contact 115 is spaced from the fixed contact 114, and a plurality of links 134 which are coupled to each other so as to rotate the main shaft 132 to the closing position and the opening position, respectively; a trip latch 295 configured to be rotatable between a restricting position where one of the links 134 is restricted to rotate to an opening position by contacting with the one of the links 134 and a releasing position where the one of the links 134 is allowed to rotate to the opening position; a trip lever 231 disposed at one side of the trip latch 295 and configured to restrict or release rotation of the trip latch 295 to the releasing position; and a signal transmission actuator 280 including a Thomson coil 281 disposed at one side of the trip lever 231 and a repulsive plate 291 configured to be separated from the Thomson coil 281 to move the trip lever 231 to the releasing position by an electromagnetic repulsive force generated when a power is applied to the Thomson coil 281, and configured to transmit the trip signal to the trip lever 231.

The vacuum interrupter 110 may be provided by each phase (for instance, R, S, and P phases) of power.

The vacuum interrupter 110 may include a vacuum container 112 maintaining a vacuum condition therein, a fixed contact 114 disposed within the vacuum container 112, and a movable contact 116 disposed within the vacuum container 112 and configured to be in contact with and separable from the fixed contact 114.

The vacuum interrupter 110 may be configured such that one of the fixed contact 114 and the movable contact 116 is connected to a main power line 117 and the other is connected to a load 118. Under such a configuration, the vacuum interrupter 110 can control power supply to the load 118 by the movement of the movable contact 116 and restrict conduction of a large-scaled current such as a fault current.

A push rod 122 may be connected to the movable contact 116 in a moving direction (lengthwise direction).

The push rod 122 may include a compression spring 124 for applying an elastic force to the movable contact 116 to contact the fixed contact 114 with a predetermined pressure.

The driving unit 130, configured to generate a driving force to drive the movable contact 116, may be disposed at one side of the vacuum interrupter 110.

The driving unit 130 may include a main shaft 132 configured to be rotatable between a closing position where the fixed contact 114 and the movable contact 116 are in contact with each other and an opening position (trip position) where the movable contact 115 is spaced and separated from the fixed contact 114, and a plurality of links 134 which are coupled to each other to rotate the main shaft 132 to the closing position and the opening position, respectively. Although not shown in the drawings, the driving unit 130 may include a closing spring to apply an elastic force to the main shaft 132 to rotate to the closing position, and an opening spring to apply an elastic force to the main shaft 132 to rotate to the opening position.

A power transmission unit 150, configured to transmit a driving force to the vacuum interrupter 110, may be provided between the driving unit 130 and the vacuum interrupter 110.

The power transmission unit 150 may include a driving arm 152 having one end connected to the main shaft 132 and another end protruded in a radius direction, a first link 154 connected to the movable contact 116 and configured to be rotatable between the closing position and the opening position, and a second link 156 having one end connected to the driving arm 152 to be relative-movable and another end connected to the first link 154 to be relative-movable.

The first link 154 may be configured to rotate centering around a pivot shaft 155 connected thereto.

The first link 154 may be connected to the push rod 122 to be relative-movable. Under such a configuration, when the first link 154 rotates to a closing position, the push rod 122 is moved upward in the drawings, and the movable contact 116 is moved to a closing position. When the second link 156 is rotated to an opening position, the push rod 122 is moved downward in the drawings, and the movable contact 116 is movable to an opening position (trip position).

Meanwhile, the driving unit 130 may include a trip latch 295 which is configured to be rotatable between a restricting position where one of the plurality of links 134 is restricted to rotate to an opening position and a releasing position where the one of the plurality of links 134 is allowed to rotate to a closing position.

The trip latch 295 may be configured to be rotatable centering around a pivot shaft 297.

The trip latch 295 may have a trip latch spring 298 configured to apply an elastic force to the trip latch 295, at its one end.

A trip lever 231, configured to restrict or release a rotation of the trip latch 295 to a releasing position, may be provided at one side of the trip latch 295.

The trip latch 295 may include a trip lever contact portion 296, at its one end, configured to contact the trip lever 231.

The trip lever 231 may be configured to rotate centering around a pivot shaft 235 which is provided at one end thereof.

The trip lever 231 may include a trip latch contact portion 2237, at its one end, configured to contact the trip latch 295.

The trip lever 231 may include, at one side thereof, a cut-out portion 238 formed along a rotation direction of the trip latch contact portion 296.

The cut-out portion 238 may be configured out of a rotational range of the trip lever contact portion 296. Under such a configuration, restriction of the trip latch 295 can be released.

The cut-out portion 238 may be formed to correspond to a releasing position of the trip lever 231.

More specifically, the trip lever 231 may be configured such that the trip latch contacting portion 237 contacts the trip lever contacting portion 296 to restrict the trip latch 295 from rotating to an opening position in a restricting position, and the cut-out portion 238 is rotated toward the trip lever contacting portion 296 to release the restriction of the trip latch 295 so that the trip latch 295 may be rotated to an opening position.

Meanwhile, a signal transmission actuator 280, configured to transmit a trip signal to the trip lever 231, may be disposed at one side of the trip lever 231.

The signal transmission actuator 280 may include a Thomson coil 281 disposed at one side of the trip lever 231, and a repulsive plate 291 configured to be separated from the Thomson coil 281 by an electromagnetic repulsive force generated when a power is applied thereto, and to move the trip lever 231 to the releasing position.

The signal transmission actuator 280 is a type of Thomson drive including the Thomson coil 281 and the repulsive plate 291, which scarcely has a time delay (for instance, 0.5 ms) from power input to completion of the operation. The repulsive plate 291, as described above, may be configured such that an eddy current may be generated for an electromagnetic repulsive force with respect to the Thomson coil 281 when a power is applied to the Thomson coil 281.

The signal transmission actuator 280 may include a housing 301 having an accommodating space to accommodate therein the Thomson coil 281 and the repulsive plate 291.

The Thomson coil 281 may be configured to have a through-hole 283 at a central portion thereof in a disk shape.

The repulsive plate 291 may include a repulsive plate body 292 of a disk shape, and an operation rod 293 protruded from the repulsive plate 292 in a moving direction.

The operation rod 293 may be configured to protrude toward the trip lever 231 and to press the trip lever 231 toward the releasing position.

The housing 301 may include a through-hole 302 through which the operation rod 293 passes.

The repulsive plate 291 may include a guide rod 294 protruded toward a moving direction.

The guide rod 294 may be provided to protrude in an opposite direction to the operation rod 293.

The housing 301 may include a guide slot 303 configured to accommodate therein the guide rod 294 to be relative-movable and to guide movement of the guide rod 294.

Meanwhile, the circuit breaker according to this embodiment of the present invention may include a control unit 270 containing a control program and implemented as a microprocessor.

Figure 19:
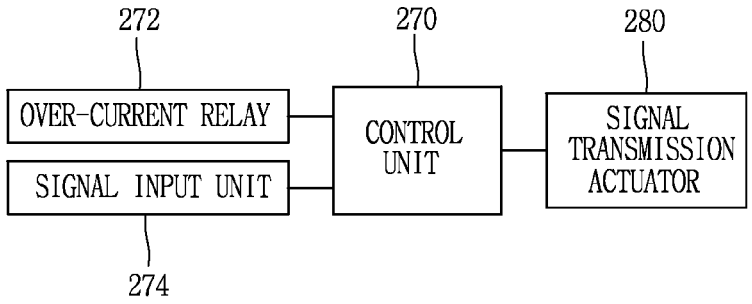
FIG. 19 is a block diagram illustrating a control procedure of the circuit breaker of FIG. 16.

As shown in FIG. 19, an over-current relay 272, configured to detect a fault current and output a trip signal to break a large-scaled current conduction, may be connected to the control unit 279.

The control unit 270 may be configured to control a power to be applied to the Thomson coil 281 so that the repulsive plate 291 may be operated, when a trip signal is output from the over-current relay 272.

A signal input unit 274, configured to input a closing signal and/or an opening signal, may be connected to the control unit 270.

The control unit 270 may be configured to control a power to be applied to the signal transmission actuator 280, when an opening signal is input from the signal input unit 274.

Under such a configuration, when a trip signal is output from the over-current relay 272, the control unit 270 may control a power to be applied to the signal transmission actuator 280.

Figure 18:
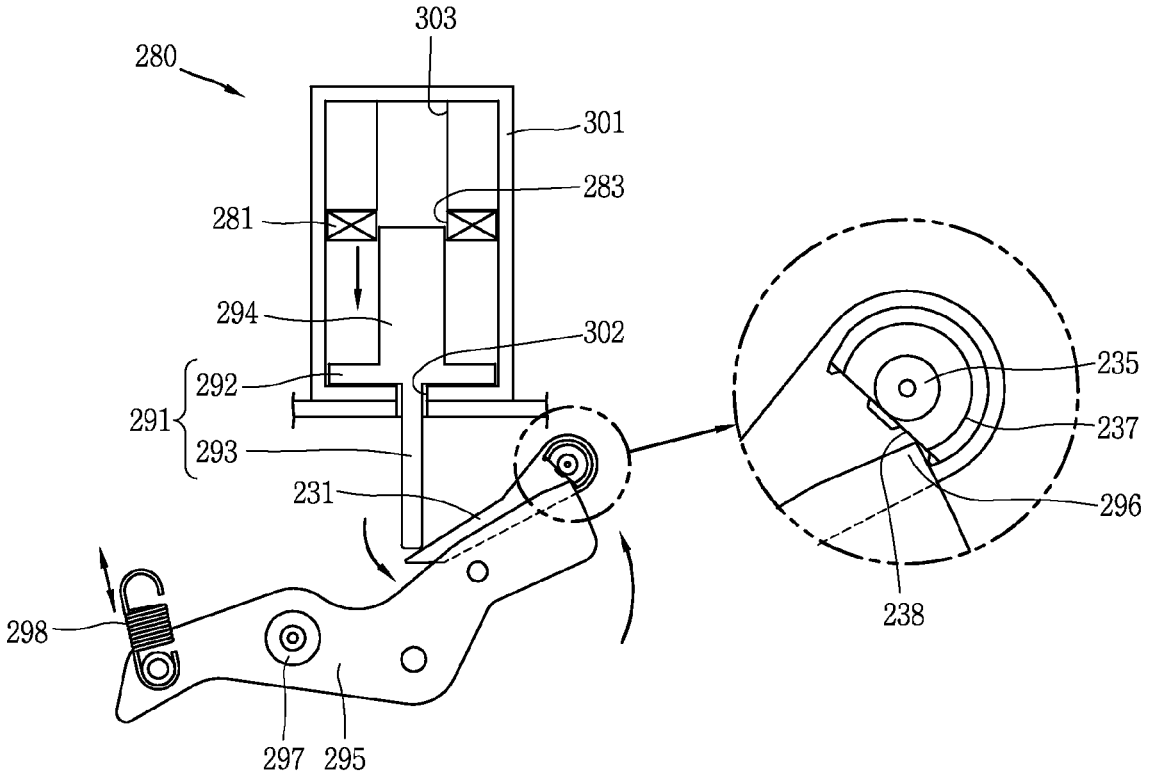
FIG. 18 is a view illustrating an operation of the signal transmission actuator of FIG. 17.

When a power is applied to the Thomson coil 281 of the signal transmission actuator 280, the repulsive plate 291 may be promptly moved so as to be spaced from the Thomson coil 281, as shown in FIG. 18.

As the repulsive plate 291 moves, the operation rod 293 which is protruded toward the trip lever 231 presses the trip lever 231 so as to be rotated to a releasing position.

When the trip lever 231 is rotated to the releasing position, the cut-out portion 238 of the trip lever 231 turns toward the trip latch 295 so that the restriction of the trip latch 295 may be released. Thus, the one of the links 134 and the main shaft 132 may be rotated to a releasing position.

When the main shaft 132 is rotated to an opening position, a driving force of the driving unit 130 may be transmitted to the push rod 122 and the movable contact 116 via the driving arm 152, the second link 156 and the first link 154.

As described above in detail, the circuit breaker according to this embodiment of the present invention is capable of remarkably reducing breaking time (within 2 ms) taken to release the trip lever 231 by the signal transmission actuator 280, after output of a trip signal from the over-current relay 272. That is, it is possible to reduce more than 3 ms when compared with the conventional one which requires more than 5 ms until the trip lever 231 is released by the solenoid.

Hereinafter, another embodiment of the present invention will be described with reference to FIGS. 20 through 23.

For the sake of brief description with reference to the drawings, the same or equivalent components may be provided with the same or similar reference numbers, and description thereof will not be repeated.

Figure 20:
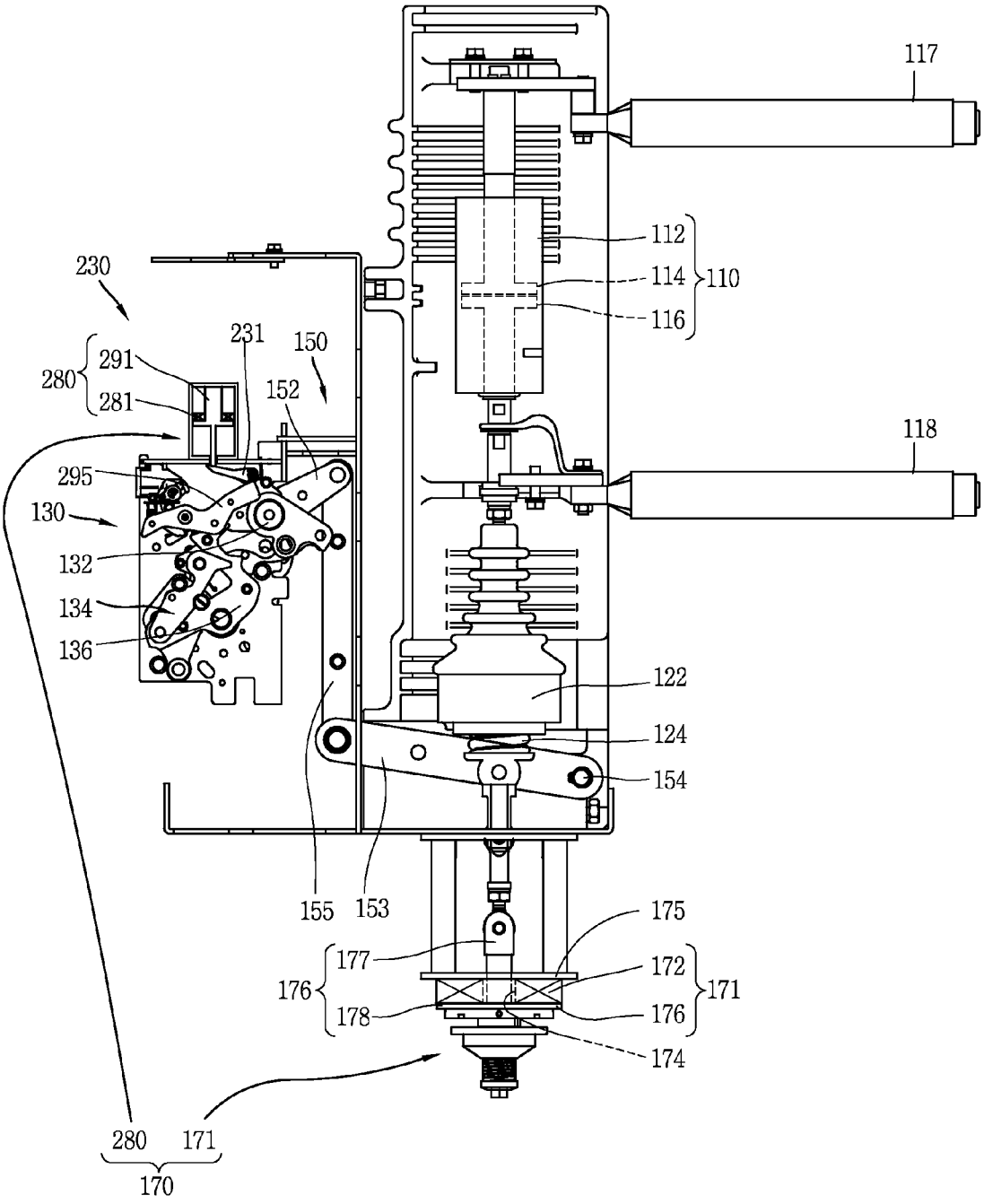
FIG. 20 is a side view illustrating a circuit breaker according to another embodiment of the present invention.
Figure 21:
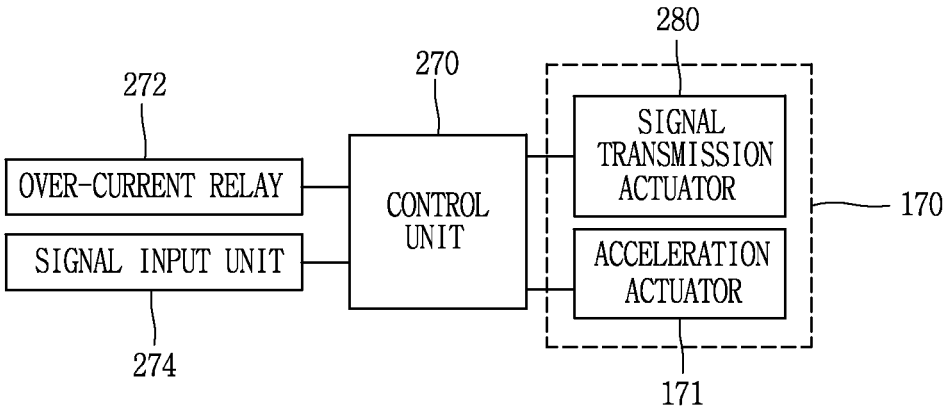
FIG. 21 is a block diagram illustrating a control procedure of the circuit breaker of FIG. 20.

As shown in FIGS. 20 and 21, a circuit breaker according to this embodiment of the present invention, may include a vacuum interrupter 110 including a fixed contact 114 and a movable contact 116; a driving unit 130 including a main shaft 132 rotatable between a closing position where the movable contact 116 contacts the fixed contact 114 and an opening position where the movable contact 116 is separated from the fixed contact 114*a*, and a plurality of springs and links 134 coupled with each other so as to rotate the main shaft 132 to the closing position and the opening position, respectively; a power transmission unit 150 disposed between the driving unit 130 and the vacuum interrupter 110 to transmit a driving force of the driving unit 130 to the movable contact 116; an over-current relay 272 configured to detect a fault current and output a trip signal to break a large-scaled current conduction; a trip unit 230 disposed at one side of the driving unit 130 and configured to generate and transmit a mechanical operation force to the trip unit 230 when a trip signal is output from the over-current relay 272; and a Thomson drive 170 including Thomson coils 172 and 281, and repulsive plates 176 and 291 configured to be spaced from the Thomson coils 172 and 281 by an electromagnetic repulsive force generated when a power is applied to the Thomson coils 172 and 281, and connected to the power transmission unit 150 to rotate the main shaft 132 to an opening position by a movement of the repulsive plate 176 when a power is applied to the Thomson coil 172, or disposed at the trip unit 230 to transmit the trip signal to the trip unit 230 by an electromagnetic repulsive force generated when a power is applied to the Thomson coils 172 and 281.

The Thomson drive 170 may include one or both of an acceleration actuator 171 and a signal transmission actuator 280. The acceleration actuator 171 includes the Thomson coil 172, and a repulsive plate 176 configured to rotate the main shaft 172 to a releasing position by an electromagnetic repulsive force generated when a power is applied to the Thomson coil 172. The signal transmission actuator 280 includes the Thomson coil 281, and a repulsive plate 291 configured to transmit a trip signal to the trip unit 230 by an electromagnetic force generated when a power is applied to the Thomson coil 281.

The power transmission unit 150, configured to transmit a driving force of the driving unit 130 to the vacuum interrupter 110, may be provided at one side of the driving unit 130.

The power transmission unit 150 may include a driving arm 152, a first link 154 and a second link 156.

A trip unit 230 may be provided at one side of the driving unit 230.

The trip unit 230 may include a trip latch 295 disposed to be rotatable between a restricting position where one of the plurality of links 134 is restricted to move to the restricting position by contacting with the main shaft 132 and a releasing position where the one of the links 134 is allowed to rotate to the opening position; a trip lever 231 disposed at one side of the trip latch 231 and configured to restrict or release the rotation of the trip latch 194 to the releasing position; a signal transmission actuator 280 including a Thomson coil 281 disposed at one side of the trip lever 231, and a repulsive plate 291 configured to move the trip lever 231 to the releasing position while being spaced from the Thomson coil 281 by an electromagnetic force generated when a power is applied to the Thomson coil 281, and configured to transmit a trip signal to the trip lever 231.

The trip latch 295 may be provided at one side of the one of the links 134 of the driving unit 130.

The trip lever 231, configured to restrict or release rotation of the trip latch 295 to the opening position, may be provided at one side of the trip latch 295.

The signal transmission actuator 280 may be provided at one side of the trip lever 231.

The signal transmission actuator 280 may include the Thomson coil 281, the repulsive plate 291 and the housing 301.

The repulsive plate 291 may include an operation rod 293 and a guide rod 294.

The housing 302 may include a guide slot 303 configured to guide the guide rod 294.

Meanwhile, the circuit breaker according to this embodiment of the present invention may include the acceleration actuator 171 including the Thomson coil 172 disposed at one side of the power transmission unit 150; and the repulsive plate 176 configured to be spaced from the Thomson coil 172 by an electromagnetic repulsive force generated when a power is applied to the Thomson coil 172 and allow the driving unit 150 to promptly move to the opening position.

Here, the acceleration actuator 171 may include the Thomson coil 172 and the repulsive plate 176, and the repulsive plate 176 is promptly moved to be spaced from the Thomson coil 172 by an electromagnetic repulsive force generated when a power is applied to the Thomson coil 172, so that time delay (for instance, 0.5 ms) scarcely occurs from the application of power to the completion of operation.

The Thomson coil 172 may be configured to have a through-hole 174 at it central portion in a disk shape.

The Thomson coil 172 may be disposed at a lower portion of the first link 154.

The repulsive plate 176 may include the repulsive plate body 178 and the connection rod 177 protruded from the repulsive plate body 178.

The connection rod 177 may be configured to be connected to the first link 154.

For instance, the connection rod 177 may be connected to a connection region between the first link 154 and the push rod 122.

Figure 22:
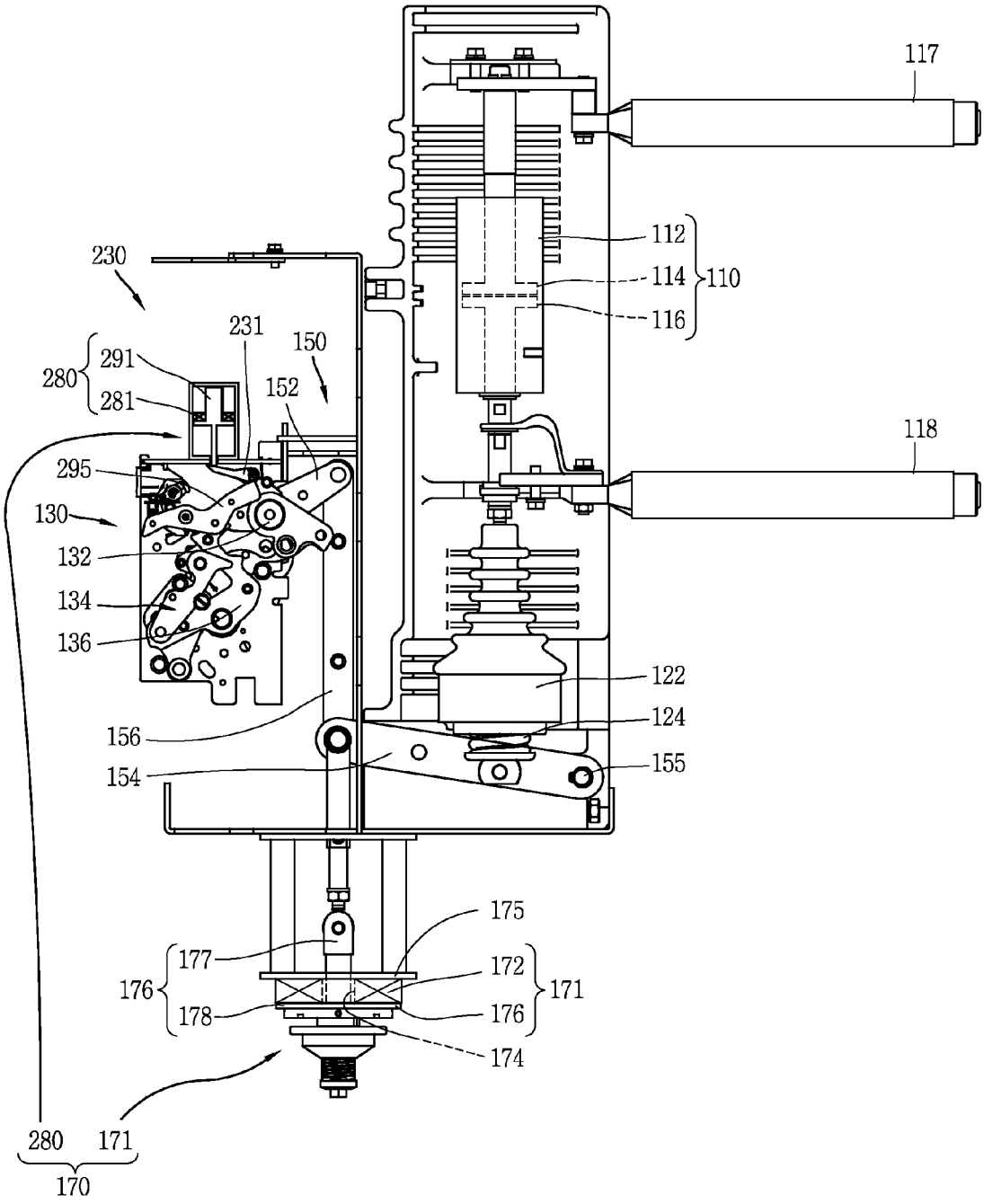
FIGS. 22 and 23 are views illustrating another embodiment of an acceleration actuator of FIG. 20, respectively.

The connection rod 177, as shown in FIG. 22, may be connected to a connection region between the first link 154 and the second link 156.

More specifically, the Thomson coil 172 may be disposed at a lower portion of the second link 156 along the moving direction, and the repulsive plate 176 may be disposed at a lower portion of the Thomson coil 172. The connection rod 177 of the repulsive plate 176 may be connected to a connection region between the first link 154 and the second link 156 in a relative-movable manner after passing through the through-hole 174 of the Thomson coil 172.

Figure 23:
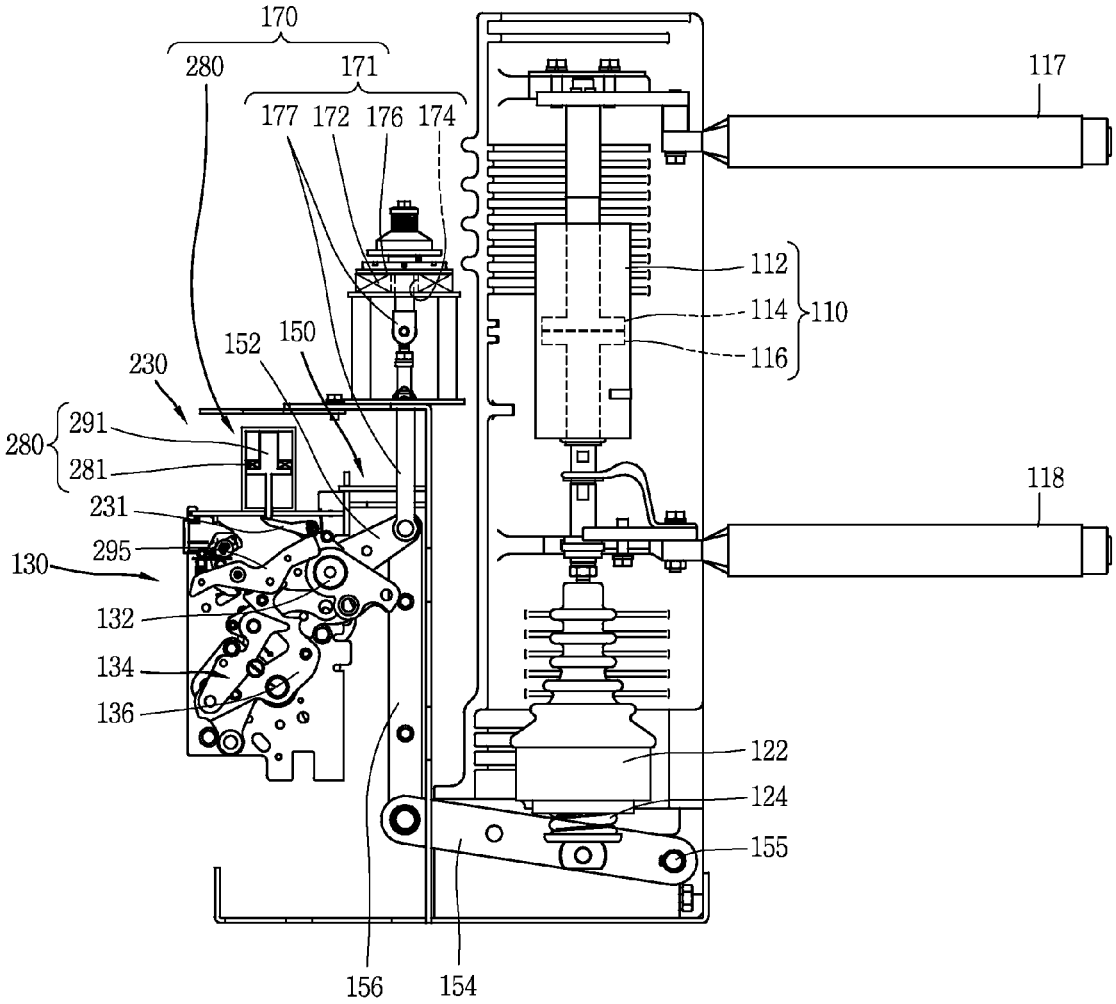

Further, the connection rod 177, as shown in FIG. 23, may be connected to a connection section between the driving arm 152 and the second link 156.

More specifically, the Thomson coil 172 may be disposed at an upper portion to the second link 156 along a moving direction thereof, and the repulsive plate 176 may be disposed at an upper portion of the Thomson coil 172. The connection rod 177 of the repulsive plate 176 may be connected to a connection region between the driving arm 152 and the second link 156 in a rotatable manner after passing through the through-hole 174 of the Thomson coil 172.

Meanwhile, the circuit breaker according to this embodiment of the present invention may include a control unit 270, as shown in FIG. 21.

The over-current relay 272, configured to detect a fault current and to output a trip signal to break a large-scaled current conduction, may be connected to the control unit 270 in a communicable manner.

A signal input unit 274, configured to input an opening signal of the vacuum interrupter 110, may be connected to the control unit 270 in a communicable manner.

The control unit 270 may be configured to control a power to be applied to the signal transmission actuator 280 when a trip signal is output from the over-current relay 272 and/or when an opening signal is input by the signal input unit 274.

The control unit 270 may be configured to control a power to be applied to the acceleration actuator 171 when a trip signal is output by the over-current relay 272.

The control unit 270 may be configured to control such that a power may be applied to the acceleration actuator 171 when the trip lever 231 is rotated to the releasing position after the trip signal has been output.

The control unit 270 may be configured to control a power to be applied to the acceleration actuator 171 when a predetermined time elapses after a trip signal has been output from the over-current relay 272.

More specifically, for instance, the control unit 270 may be configured to control a power to be applied to the acceleration actuator 171 when 1.5~2.5 ms elapses after a trip signal has been output from the over-current relay 272. Thus, the main shaft 132 is first rotated to the opening position before releasing of the trip lever 231 so that relatively-movable elements (for instance, the main shaft 132, the trip lever 231, and the trip latch 295) may be protected from damage.

Under such a configuration, when a trip signal is output from the over-current relay 272, the control unit 270 controls a power to be applied to the signal transmission actuator 280.

When a power is applied to the Thomson coil 281 of the signal transmission actuator 280, the repulsive plate 291 may be promptly moved so as to be spaced from the Thomson coil 281.

As the repulsive plate 291 moves, the operation rod 293 which is protruded toward the trip lever 231 presses the trip lever 231 so that the trip lever 231 can be rotated to a releasing position.

Once the trip lever 231 is rotated to a releasing position, the cut-out portion 238 of the trip lever 231 turns toward the trip latch 295 so that the restriction of the trip latch 295 may be released. Thus, the one of the links 134 and the main shaft 231 may be rotated to a restricting position.

Meanwhile, the control unit 270 may control a power to be applied to the acceleration actuator 171 after the trip lever 231 has been rotated to the releasing position and a predetermined time (for instance, 1.5~2.5 ms) has elapsed.

When a power is applied to the Thomson coil 172 of the acceleration actuator 171, the repulsive plate 176 of the acceleration actuator 171 may be promptly moved so as to be spaced from the Thomson coil 172.

As the repulsive plate 176 is moved, the first link 154, the second link 156, the driving arm 152, and the main shaft 132, which are connected to one another for interlocking, may be operated to promptly turn to the opening position.

As the first link 154 is rotated to the opening position, the push rod 122 is moved downward, and thus the movable contact 116 may be promptly separated to be spaced from the fixed contact 114.

As described above in detail, the circuit breaker according to this embodiment of the present invention is capable of remarkably reducing breaking time (within 2 ms) more than 3 ms taken to release the trip lever 231 by the signal actuator 280, after output of a trip signal from the over-current relay 272, when compared with the conventional method in which more than 5 ms are required to release the trip lever 231 by the solenoid.

Further, in the conventional art, more than about 5 ms time delay is generated to rotate the main shaft 132 to the opening position by a driving force of the driving unit 130, that is, an elastic force of the opening spring and the compression spring 124, whereas the circuit breaker according to this embodiment of the present invention can reduce the time delay approximately by more than 3 ms since it is possible to rotate the main shaft 132 to the closing position by the acceleration actuator 171 within 2 ms.

As described above in detail, according to this embodiment of the present invention, the main shaft can be promptly rotated to the opening position by the interaction between the Thomson drive and the unlatch unit so that a fault current can be promptly cut-off within 1.5 cycles after output of a trip signal.

Further, by providing the signal transmission actuator including the Thomson coil and the repulsive plate, time delay is restricted by an electromagnetic repulsive force when a power is applied. Thus, a signal is promptly transmitted, thereby promptly breaking a fault current.

Further, by providing the signal transmission actuator including the Thomson coil and the repulsive plate, the main shaft and the power transmission unit are promptly moved to the breaking position by the acceleration actuator at the initial stage of the rotation to the breaking position of the main shaft. Thus, generation of time delay by the operation of the elastic force of the opening spring may be restrained, thereby promptly breaking a fault current.

Further, since a power is applied to the acceleration actuator after a power has been applied to the signal transmission actuator and a predetermined time has elapsed, a damage of the elements due to the driving force of the acceleration actuator can be restrained.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker, comprising:

a vacuum interrupter including a fixed contact and a movable contact;

a driving unit including a main shaft rotatable between a closing position where the movable contact contacts the fixed contact and an opening position where the movable contact is separated from the fixed contact, and a plurality of links interlocked with the main shaft, and configured to supply a driving force to open and close the vacuum interrupter;

a power transmission unit disposed between the driving unit and the vacuum interrupter, and configured to transmit a driving force of the driving unit to the movable contact;

an over-current relay configured to detect a fault current and to output a trip signal to break a large-scaled current conduction;

a trip unit disposed at one side of the driving unit, and configured to generate and transmit a mechanical operation force to the driving unit when a trip signal is output from the over-current relay; and a Thomson drive including a Thomson coil, and a repulsive plate configured to be spaced from the Thomson coil by an electromagnetic repulsive force when a power is applied to the Thomson coil, the Thomson drive configured to be connected to the power transmission unit to rotate the main shaft to an opening position by a movement of the repulsive plate when a power is applied to the Thomson coil, or the Thomson drive configured to be provided at the trip unit and to transmit the trip signal to the trip unit by a movement of the repulsive plate when a power is applied to the Thomson coil, wherein the Thomson drive is provided at the trip unit, and wherein the trip unit comprises: a trip latch disposed to be rotatable between a restricting position where one of the links is restricted from being rotated to the closing position by contacting the one of the plurality of links that rotate the main shaft to the closing position, and a releasing position where the one of the links is allowed to rotate to the closing position; and a trip lever disposed at one side of the trip latch and configured to restrict the trip latch from rotating to the releasing position or configured to release the restriction, and wherein the Thomson drive comprises a signal transmission actuator, wherein the signal transmission actuator comprises:

a Thomson coil disposed at one side of the trip lever; and a repulsive plate disposed at one side of the Thomson coil and configured to move the trip lever to the releasing position when a power is applied to the Thomson coil.

2. The circuit breaker of claim 1, further comprising;

a control unit configured to apply a power to the Thomson coil when a trip signal is output from the over-current relay; and an unlatch unit disposed at one side of one of the plurality of links and configured to be rotatable between a restricting position where the driving unit is restrained from being rotated to the opening position and a releasing position where the driving unit is rotated from the restricting position so that the driving unit is rotated to the opening position when the main shaft is rotated to the opening position by the Thomson drive, wherein the Thomson drive is connected to the power transmission unit, the trip unit is disposed at one side of an unlatch unit and configured to rotate the unlatch unit to a releasing position when an opening signal is applied thereto.

3. The circuit breaker of claim 2, wherein the unlatch unit comprises:

an operation pin configured to contact one of the links;

a first trip latch including the operation pin and configured to be rotatable such that the operation pin is rotated to the restricting position and the releasing position, respectively;

a first trip latch spring configured to apply an elastic force to the operation pin so as to be in contact with the one of the links;

a second trip latch disposed to be relative rotatable with respect to the first trip latch and having one side contacting the operation pin; and a second trip latch spring having one end supported by the first trip latch, and another end elastically supporting the second trip latch in a contacting manner.

4. The circuit breaker of claim 3, wherein the trip unit comprises:

a trip lever disposed to contact the second trip latch and configured to restrict the first trip latch and the second trip latch from being rotated to a releasing position; and a solenoid disposed at one side of the trip lever and configured to rotate the trip lever to the releasing position where the first trip latch and the second trip latch are rotated to the releasing position.

5. The circuit breaker of claim 2, wherein the power transmission unit comprises:

a driving arm having one end connected to the main shaft and another end protruded in a radius direction;

a first link connected to the movable contact and configured to be rotatable between a closing position where the movable contact contacts the fixed contact and an opening position where the movable contact is spaced from the fixed contact; and a second link having one end connected to the driving arm and another end connected to the first link.

6. The circuit breaker of claim 5, wherein the repulsive plate includes a connection rod extended through the Thomson coil and connected to the power transmission unit.

7. The circuit breaker of claim 6, wherein the connection rod is connected to a connection region between the first link and the second link.

8. The circuit breaker of claim 7, wherein the connection rod is connected to the first link.

9. The circuit breaker of claim 8, wherein the first link is provided with a compression spring configured to apply an elastic force to the movable contact so as to be in contact with the fixed contact at a predetermined pressure, and wherein the connection rod is connected to a connection region between the first link and the push rod.

10. The circuit breaker of claim 6, wherein the connection rod is connected to a connection region between the driving arm and the second link.

11. The circuit breaker of claim 1, wherein the power transmission unit comprises:

a driving arm connected to the main shaft;

a first link disposed at one side of the movable contact and configured to move the movable contact to the closing position and the opening position; and a second link having one end connected to the driving arm and another end connected to the first link.

12. The circuit breaker of claim 11, wherein the Thomson drive further comprises an acceleration actuator including:

a Thomson coil disposed at one side of the power transmission unit; and a repulsive plate configured to move the power transmission unit to the opening position by being spaced from the Thomson coil by an electromagnetic repulsive force generated when a power is applied to the Thomson coil.

13. The circuit breaker of claim 12, wherein the repulsive plate of the acceleration actuator comprises a connection rod which is extended through the Thomson coil.

14. The circuit breaker of claim 13, wherein connection rod is connected to one of the connection region between the first link and the second link, the connection region between the driving arm and the second link, and the first link.

15. The circuit breaker of claim 14, wherein the first link is connected to the push rod having one end connected to the movable contact, and wherein the connection rod is connected to the connection region between the first link and the push rod.

16. The circuit breaker of claim 11, wherein the repulsive plate includes an operation rod which is protruded toward the trip lever.

17. The circuit breaker of claim 16, further comprising a housing configured to accommodate therein the Thomson coil and the repulsive plate.

18. The circuit breaker of claim 17, wherein the repulsive plate includes a guide rod which is protruded in a moving direction, and wherein the housing includes a guide slot configured to guide movement of the guide rod.

19. The circuit breaker of claim 12, further comprising a control unit configured to control a power to be applied to the Thomson coil when a trip signal is output from the over-current relay, and to control a power to be applied to the acceleration actuator when a predetermined time elapses after a power has been applied to the acceleration actuator.

* * * * *